US007593671B2

(12) United States Patent
Ishikawa et al.

(10) Patent No.: US 7,593,671 B2
(45) Date of Patent: Sep. 22, 2009

(54) DEVELOPING DEVICE, A DEVELOPING METHOD, A PROCESS CARTRIDGE AND AN IMAGE FORMING APPARATUS

(75) Inventors: Emiko Ishikawa, Sagamihara (JP); Chiemi Kaneko, Tokyo (JP); Hirokatsu Suzuki, Zama (JP); Kenichi Taguma, Sagamihara (JP)

(73) Assignee: Ricoh Company, Ltd., Tokyo (JP)

( * ) Notice: Subject to any disclaimer, the term of this patent is extended or adjusted under 35 U.S.C. 154(b) by 148 days.

(21) Appl. No.: 11/567,120

(22) Filed: Dec. 5, 2006

(65) Prior Publication Data

US 2007/0127951 A1 Jun. 7, 2007

(30) Foreign Application Priority Data

Dec. 5, 2005 (JP) ..... 2005-350580
Oct. 11, 2006 (JP) ..... 2006-277122

(51) Int. Cl.
*G03G 15/08* (2006.01)

(52) U.S. Cl. ..... 399/254; 399/309; 430/110.3; 430/110.4

(58) Field of Classification Search ..... 399/254, 399/256, 258, 259, 309; 222/DIG. 1; 430/110.3, 430/110.4
See application file for complete search history.

(56) References Cited

U.S. PATENT DOCUMENTS 5,659,859 A * 8/1997 Kikuta et al. ..... 399/256
5,937,228 A 8/1999 Shoji et al. ..... 399/55
5,950,056 A * 9/1999 Hamamichi et al. ..... 399/256
5,970,280 A 10/1999 Suzuki et al. ..... 399/55
6,173,148 B1 1/2001 Matsuda et al. ..... 399/310
6,347,214 B1 2/2002 Kaneko ..... 399/397
6,366,751 B1 4/2002 Shakuto et al. ..... 399/159
6,757,509 B2 6/2004 Shoji et al. ..... 399/267
6,801,742 B1 10/2004 Mochimaru et al. ..... 399/309
6,983,117 B2 1/2006 Schmiya ..... 399/307
7,003,251 B2 2/2006 Suzuki et al. ..... 399/309
7,039,349 B2 5/2006 Sohmiya et al. ..... 399/309
7,054,587 B2 5/2006 Sohmiya et al. ..... 399/309
7,082,282 B2 7/2006 Kaneko ..... 399/309

(Continued)

FOREIGN PATENT DOCUMENTS

JP 07-175306 7/1995

(Continued)

OTHER PUBLICATIONS

U.S. Appl. No. 12/049,838, filed Mar. 17, 2008, Senoh, et al.

*Primary Examiner*—Sophia S Chen
(74) *Attorney, Agent, or Firm*—Oblon, Spivak, McClelland, Maier & Neustadt, P.C.

(57) ABSTRACT

A developing device includes a developer bearing member, a developer supplying conveyer, a developer receiving conveyer and a developer agitating conveyer. The developer supplying conveyer or the developer receiving conveyer has at least one dividing position. The dividing position is a position at which the conveying direction of the developer reverses, and a position which is arranged so that if the dividing position is projected to the developer bearing member along a plane which is perpendicular to the widthwise direction of the developer bearing member, the projected position on the developer bearing member is within an area in which the developer is borne on the developer bearing member.

37 Claims, 26 Drawing Sheets

U.S. PATENT DOCUMENTS

| | | | | |
|---|---|---|---|---|
| 7,085,514 | B2 | 8/2006 | Kaneko | 399/101 |
| 2004/0131398 | A1 | 7/2004 | Omata | 399/309 |
| 2004/0141776 | A1* | 7/2004 | Sohmiya et al. | 399/309 |
| 2005/0152707 | A1 | 7/2005 | Suzuki et al. | 399/27 |
| 2005/0169677 | A1* | 8/2005 | Kaneko | 399/309 |
| 2005/0254846 | A1 | 11/2005 | Yura et al. | 399/67 |
| 2005/0275896 | A1 | 12/2005 | Taguma | 358/1.18 |
| 2006/0008281 | A1* | 1/2006 | Matsumoto et al. | 399/27 |
| 2006/0204283 | A1 | 9/2006 | Yasuda | 399/254 |
| 2007/0025773 | A1* | 2/2007 | Tateyama et al. | 399/254 |
| 2007/0122202 | A1* | 5/2007 | Taguma et al. | 399/254 |
| 2008/0124106 | A1 | 5/2008 | Enoki et al. | |

FOREIGN PATENT DOCUMENTS

| | | |
|---|---|---|
| JP | 11-007195 | 1/1999 |
| JP | 11-024403 | 1/1999 |
| JP | 11-133710 | 5/1999 |
| JP | 11-167260 | 6/1999 |
| JP | 2981812 (B2) | 9/1999 |
| JP | 2001-290369 | 10/2001 |
| JP | 2003-167435 | 6/2003 |
| JP | 2004-189437 | 7/2004 |
| JP | 2006-251440 | 9/2006 |

* cited by examiner

DEVELOPING DEVICE, A DEVELOPING METHOD, A PROCESS CARTRIDGE AND AN IMAGE FORMING APPARATUS

CROSS REFERENCE TO RELATED APPLICATION

This application is claiming foreign priority of Japanese patent application No. 2005-350580 and Japanese patent application No. 2006-277122 whose entire disclosure is incorporated by reference herein.

FIELD OF THE INVENTION

This invention relates to a developing device for developing latent electrostatic images to toner images with developer. The developing device is used in an image forming apparatus such as a copying machine, a printer, fax machine or the like.

DESCRIPTION OF THE RELATED ART

An conventional electrostatic image forming machine, such as a copying machine, typically forms toner images by charging a surface of a latent image carrier, exposing the charged surface of the latent image carrier to form latent images, developing the latent images to toner images, transferring the toner images to recording media such as paper sheets and fixing the toner images to the recording media with heat.

In the developing device using a two-component developer which comprises toner particles and carrier particles, the toner particles in the developer are consumed during the development process. So, after the development process, new toner particles are supplied to the developer and stirred with the developer so that the developer can be used for the development process again. In this type of developing device, it is required to maintain a toner density in the developer and a charge quantity of the toner particles within predetermined ranges in order to stabilize the quality of the toner images. The toner density depends on the distribution of consumed toner particles and the distribution of newly supplied toner particles. The charge quantity of the toner particles depends on the condition of the friction between the carrier particles and the toner particles stirred together. In the developing device, the developer is agitated in order to adequately uniformly distribute toner particles and in order to electrically charge the toner particles enough for stabilizing the quality of the toner image.

A conventional developing device with two developer conveyers is shown in FIG. 23. In FIG. 23, a developer supplying conveyer 104 as the first developer conveyer and a developer agitating conveyer 101 as the second developer conveyer are horizontally disposed below the developer bearing member 103. The developer bearing member 103 bears the developer in order to supply the developer to the development area in which the developer bearing member 103 faces the latent image carrier. The developer supplying conveyer 104 supplies the developer to the developer bearing member 103 and receives the developer from the developer bearing member 103 while conveying the developer, and the developer agitating conveyer 101 receives the developer from the downstream of the developer supplying conveyer 104 and supplies the developer to the upstream of the developer supplying conveyer 104 while conveying the developer. However, in this conventional developing device, it is difficult to suppress the deterioration of the developer.

Japanese Laid-Open Patent Publication No. 11-167260 and No. 2001-290369 disclose developing devices with three conveyers. As shown in FIG. 20, Japanese Laid-Open Patent Publication No. 11-167260 discloses a developer receiving conveyer 120 as the third developer conveyer. The developer receiving conveyer 120 receives the developer having passed a development area from the developer bearing member 123 while conveying the developer and supplies the developer back to the developer agitating conveyer 122. The developer receiving conveyer 120 is described to be useful for keeping a toner density in the developer within the predetermined range when the developer is supplied to the developer supplying conveyer 117. As the result, the unevenness of the density in a toner image can be suppressed.

Laid-Open Patent Publication No. 2001-290369 discloses a developing device, as shown FIG. 21, which comprises an rotating developer bearing member 441 disposed nearby an latent image carrier 1, plural magnets 442 disposed within the developer bearing member 441 for generating a magnetic field to keep a developer on the surface of the developer bearing member 441, a developer ripping member for ripping the developer from the developer bearing member 441, a developer supplying conveyer 444 for supplying the developer to the developer bearing member 441, a developer receiving conveyer 445 disposed parallel to and above the developer supplying conveyer 444 for receiving the ripped developer from the developer bearing member 441, a developer agitating conveyer 446 for receiving the developer from the downstream of the developer supplying conveyer 444 so as to agitate the developer and send the developer to the upstream of the developer supplying conveyer 444, a developer supplying conveyer-containing space 401 for containing the developer supplying conveyer 444, a developer receiving conveyer-containing space 402 for containing the developer receiving conveyer 445, a developer agitating conveyer-containing space 403 for containing the developer agitating conveyer 446, a partitioning member for partitioning the developer supplying conveyer-containing space 401 from the developer receiving conveyer-containing space 402, an opening of the partitioning member for sending the developer from the developer receiving conveyer-containing space 402 to the developer supplying conveyer-containing space 401 at the downstream in the developer conveying direction.

The developer ripped by the ripping member is sent to the developer receiving conveyer-containing space 402 in order to be agitated and conveyed by the developer receiving conveyer 445. It is then sent to the downstream of the developer supplying conveyer-containing space 401 through the opening in order to be agitated and conveyed by the developer supplying conveyer 444, sent to the developer agitating conveyer-containing space 403 in order to be agitated and conveyed by the developer agitating conveyer 446, sent to the upstream of the developer supplying conveyer-containing space 401 and sent to the developer bearing member 441 for further development.

The developing device is described to be useful for keeping the toner density in the developer within the predetermined range when the developer is supplied to the developer supplying conveyer. As the result, the unevenness of the dense in toner images can be suppressed.

The developing device with three conveyers described above, in which the developer at the downstream of the development area is sent to the developer receiving conveyer instead of sent back directly to the developer supplying conveyer, can prevent the decline of the toner density at the downstream of the developer supplying conveyer which causes the unevenness of the toner density on the developer supplying conveyer in the widthwise direction. However, the developing device with three conveyers causes new problems to be solved. First, the amount of the developer on the developer supplying conveyer decreases in the downstream direction, resulting in the shortage of the developer. Second, the amount of the developer on the developer receiving conveyer becomes too much to be received at the downstream direction, resulting in the packing of the developer or adhesion of the developer to the developer bearing member.

To increase the rotating speed of the developer supplying conveyer or to increase the diameter of the developer supplying conveyer can be a solution to these new problems, but those solutions have only limited effect because of the endurance of a bearing supporting the developer supplying conveyer or because of the available space, especially when applied to an image forming apparatus with high image forming speed or long widthwise length.

FIG. 22 shows the simplified flow of the developer in the conventional developing device shown in FIG. 20 or FIG. 21.

In FIG. 22, the developer bearing member is indicated with number 123, 442 indicating the index 123 in FIG. 20 or the index 442 in FIG. 21. The developer supplying conveyer is indicated with number 117, 444 indicating the index 117 in FIG. 20 or the index 444 in FIG. 21, the developer receiving conveyer is indicated with number 120, 402 indicating the index 120 in FIG. 20 or the index 402 in FIG. 21, and the developer agitating conveyer is indicated with number 122, 446 indicating the index 122 in FIG. 20 or the index 446 in FIG. 21.

The white arrow indicates the flow of the developer and the dotted area indicates the amount of the developer. To simplify, the widthwise length of the developer supplying conveyer, the developer receiving conveyer and the developer agitating conveyer are set to be the same.

The weight of the developer per one unit of the length at the downstream end of the developer receiving conveyer "Mr", and the weight of the developer per one unit of the length at the downstream end of the developer supplying conveyer "ms" can be calculated as follows:

$$Mr=\rho vL/u3$$

$$ms=Ms-\rho vL/u1$$

wherein L (m) is the widthwise length on the developer bearing member on which the developer is borne, wherein L can be equal to or longer than a widthwise length of the development area on which development process is executed, $\rho(kg/m^2)$ is the amount of the developer on the developer bearing member per one unit of the area, v (m/sec) is the speed of the surface of the developer bearing member in the rotating direction, Ms (kg/m) is the weight of the developer per one unit of the length at the upstream end of the supplying member, u3 (m/sec) is the speed of the developer conveyed by the developer receiving conveyer and u1 (m/sec) is the speed of the developer conveyed by the developer supplying conveyer.

These equations indicate that, if ρ, v and L are fixed, u3 and u1 should be increased in order to decrease Mr or in order to increase ms.

Japanese Laid-Open Patent Publication No. 11-24403 and Japanese Patent No. 2981812 disclose a developing device with two developer agitating conveyers and one developer supplying/receiving conveyer, as shown in FIGS. 24 and 25. This developing device has an opening (483 in FIG. 24 or 818 in FIG. 25) disposed at the center of a partitioning member for partitioning the developer supplying/receiving conveyer from two developer agitating conveyers. The opening is set up in order to prolong the length of the developer agitating path in order to suppress the imbalance of a toner density in a widthwise direction.

However, the above-mentioned new problems caused in the developing device with three developer conveyers have not been solved.

SUMMARY OF THE INVENTION

One aspect of the present invention includes a developer bearing member, a developer supplying conveyer, a developer receiving conveyer and a developer agitating conveyer.

The developer bearing member carries a developer to an development area so that the developer on the developer bearing member faces to a latent image carrier for development process.

The developer supplying conveyer supplies the developer to the developer bearing member while conveying the developer in a widthwise direction, The developer receiving conveyer receives the developer from the developer bearing member after development while conveying the developer in the widthwise direction, The developer agitating conveyer receives the developer from the developer receiving conveyer and the developer supplying conveyer and supplies the developer to the developer supplying conveyer while agitating and conveying the developer in the widthwise direction.

The developer supplying conveyer or the developer receiving conveyer has at least one dividing position. The dividing position is a position at which the conveying direction of the developer reverses, and a position which is arranged so that if the dividing position is projected to the developer bearing member along a plane which is perpendicular to the widthwise direction of the developer bearing member, the projected position on the developer bearing member is within an area in which the developer is borne on the developer bearing member.

Accordingly, a first object of this invention is to provide a new developing device in which the shortage of the developer at the downstream of the developer supplying conveyer is improved, and in which the overflow of the developer at the downstream of the developer receiving conveyer is sufficiently suppressed. A second object of this invention is to improve the imbalance with regard to the amount of the developer in the widthwise direction on the developer supplying conveyer and the developer receiving conveyer.

DETAILED DESCRIPTION OF THE PREFERRED EMBODIMENTS

The present invention will be described in more detail below with reference to the accompanying drawings illustrating preferred embodiments. Although various modifications will be possible for those skilled in the art after receiving the present disclosure, the embodiments described below are only the preferred embodiments and the present invention is not limited to the embodiments.

In following embodiments, a developer supplying conveyer, a developer receiving conveyer and a developer agitating conveyer each has the shape of screw and may be also described as a "developer supplying screw", a "developer receiving screw", or a "developer receiving screw". Any of these conveyers may be described as just "screws".

The shape of the developer supplying conveyer, the developer receiving conveyer and the developer agitating conveyer is not restricted to be a screw type and various shapes are applicable to the present invention as long as it conveys the developer.

In following descriptions, a developing device develops latent images to toner images with a two-component developer. The two-component developer includes toner particles and magnetic carrier particles. The developer bearing member includes a sleeve on which the developer is carried and magnets inside the sleeve configured to attract the developer on the sleeve and configured to make the magnetic field along which the carrier particles form chain-like shapes called "magnetic brushes". The sleeve can rotate while the magnets are fixed. The developer is attracted and borne on the sleeve by the magnetic force from the magnets and is carried to a "development area" in response to the rotation of the sleeve. In the "development area", the developer forms "magnetic brushes" configured to contact with a photoconductor as a latent image carrier. The toner particles are transported to the photoconductor in response to an electric bias between the sleeve and the photoconductor. It is also possible that a "magnetic brush" does not touch the surface of the photoconductor.

The present invention is suitable to this type of developing device. However, it is possible to apply the present invention to a known developing device using a one-component developer which includes toner particles but does not include carrier particles.

Figure 24:
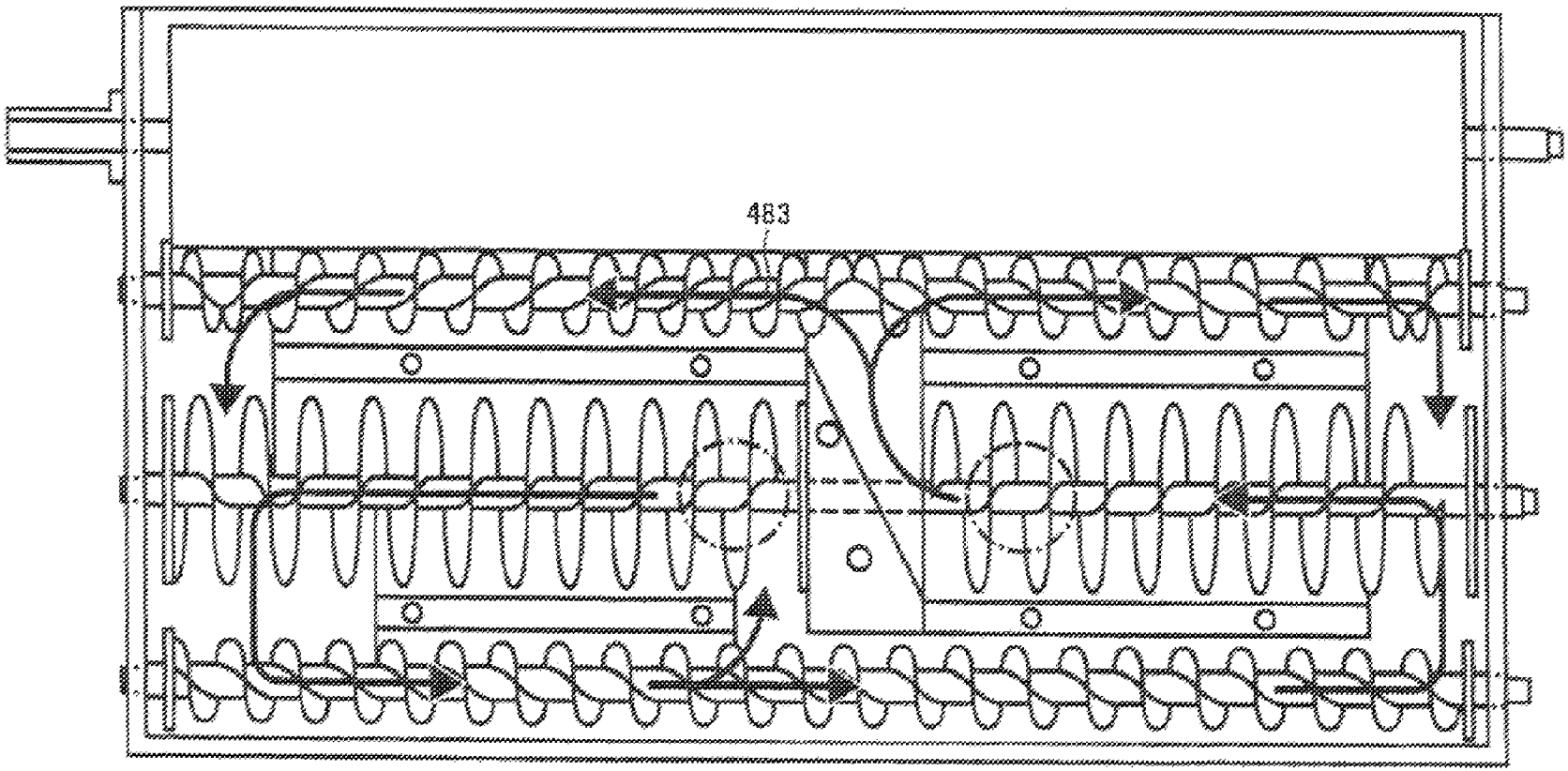
FIG. 24 RELATED ART
FIG. 24 shows a conventional developing device with two developer agitating conveyers and one developer supplying/receiving conveyer.
Figure 25:
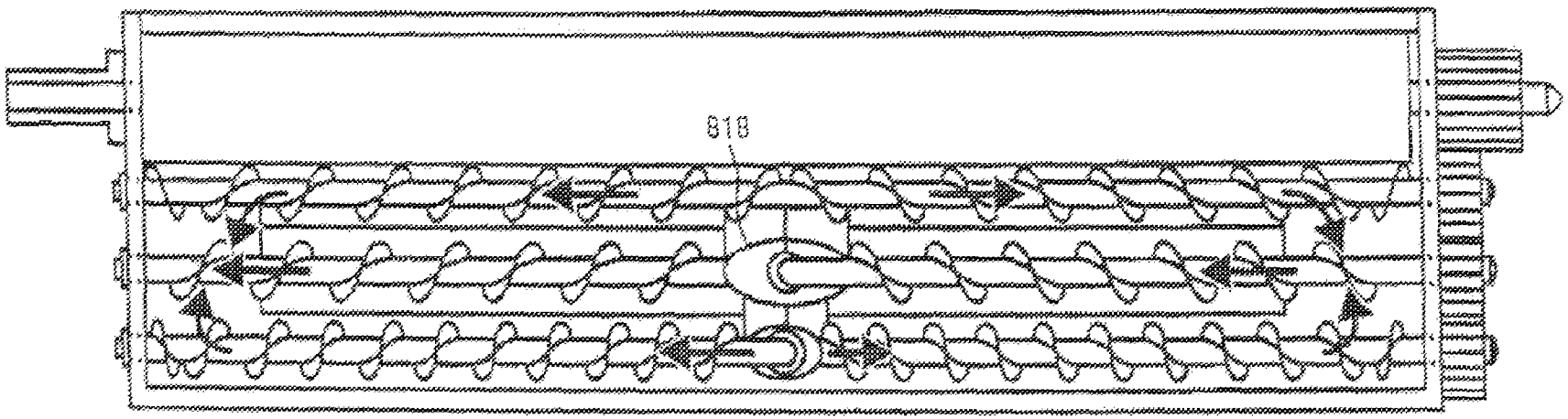
FIG. 25 RELATED ART
FIG. 25 shows a conventional developing device with two developer agitating conveyers and one developer supplying/receiving conveyer.

The developing device described in Japanese Laid-Open Patent Publication No. 11-24403 (FIG. 24) and Japanese Patent No. 2981812 (FIG. 25) is essentially different from the present invention. The present invention provides an improvement for the developing device which includes a developer receiving conveyer, a developer supplying conveyer and a developer agitating conveyer so that the developer at the downstream of the development area is not sent back to the developer supplying conveyer directly. The improvement is not for the developing device which includes two developer agitating conveyers and one developer supplying/receiving conveyer as shown in the related arts. The functional difference of each conveyer results in a difference of the purpose and the function.

The purpose of the related arts is to improve the efficiency of agitation and to suppress the toner density fluctuation in the widthwise direction. The toner density fluctuation happens because two functions (supplying and receiving the developer) are given to one conveyer (the developer supplying/receiving conveyer).

On the other hand, the purpose of the present invention is to improve an imbalance with regard to the amount of the developer in the widthwise direction. The imbalance happens because the developer at the downstream of the development area is not sent back directly to the developer supplying conveyer. The developing device described in Japanese Laid-Open Patent Publication No. 11-24403 and Japanese Patent No. 2981812 does not have this new problem of the imbalance with regard to the amount of the developer in the widthwise direction.

In this invention, the shortage of the developer at the downstream of the developer supplying conveyer can be improved by reversing a conveying direction of the developer on the developer supplying conveyer in order to suppress the fluctuation of the amount of the developer. The overflow of the developer at the downstream of the developer receiving conveyer can be improved by reversing the conveying direction of the developer on the developer receiving conveyer in order to suppress the fluctuation of the developer amount.

It is preferable to solve the shortage and the overflow of the developer together in order to use the developing device with the developer receiving conveyer, the developer supplying conveyer and the developer agitating conveyer. This invention can solve those two problems together by reversing the conveying direction of the developer on the developer supplying conveyer and the developer receiving conveyer.

Embodiment

To better understand the present invention, the amount of the developer in a widthwise direction in the developing device of the present invention will be described in FIG. 1B in comparison to FIG. 22.

Figure 19:
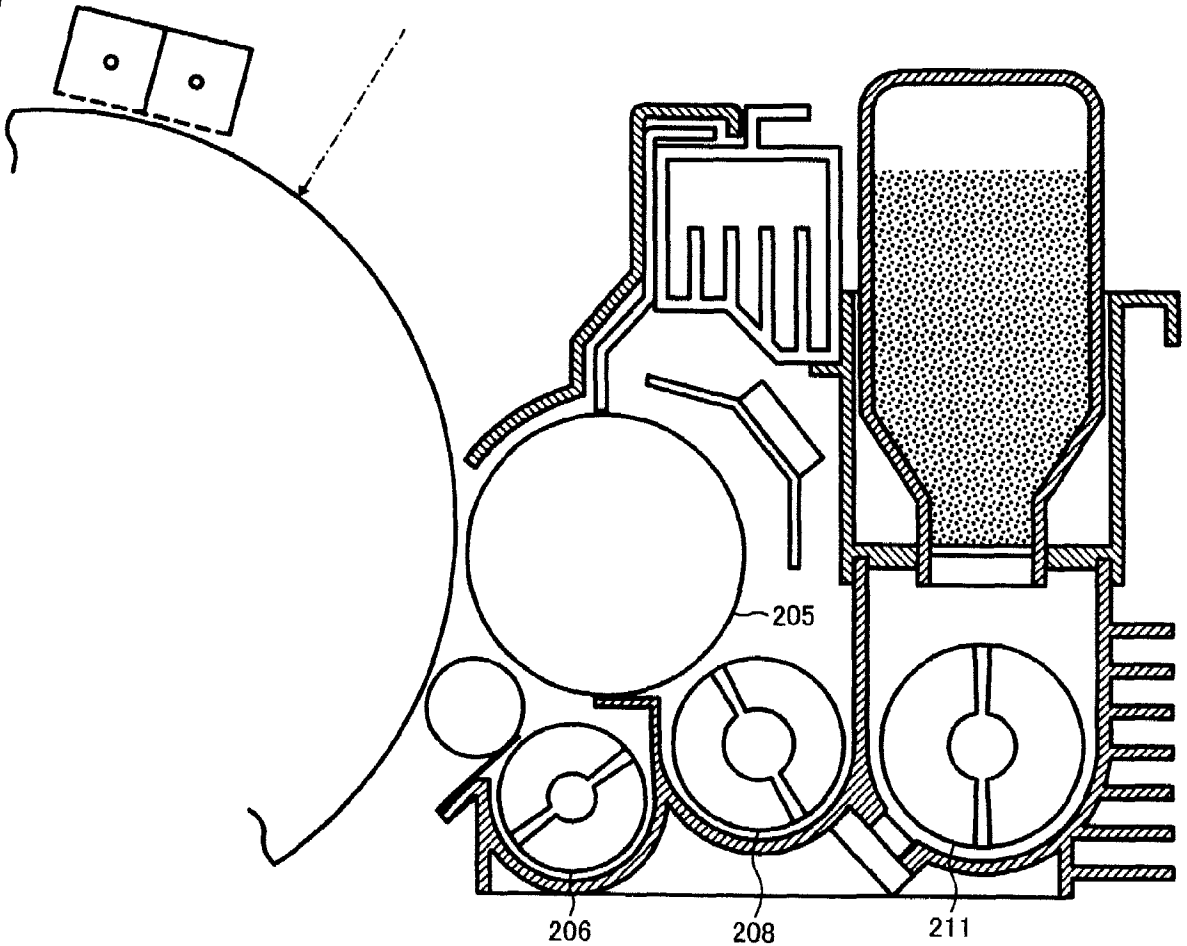
FIG. 19 shows a developing device to which the present invention can be applied.

A developing device of this embodiment is shown in FIG. 19. The developing device includes a developer bearing member 205, a developer supplying conveyer 208, a developer receiving conveyer 206 and a developer agitating conveyer 211. The developer bearing member and the three screws are disposed approximately horizontally.

The developer bearing member includes a rotating sleeve and magnets fixed inside the sleeve. The developer on the developer bearing member is attached to the developer bearing member because of the magnetic field generated by magnets inside the sleeve and conveyed by the rotation of the sleeve.

Figure 1A:
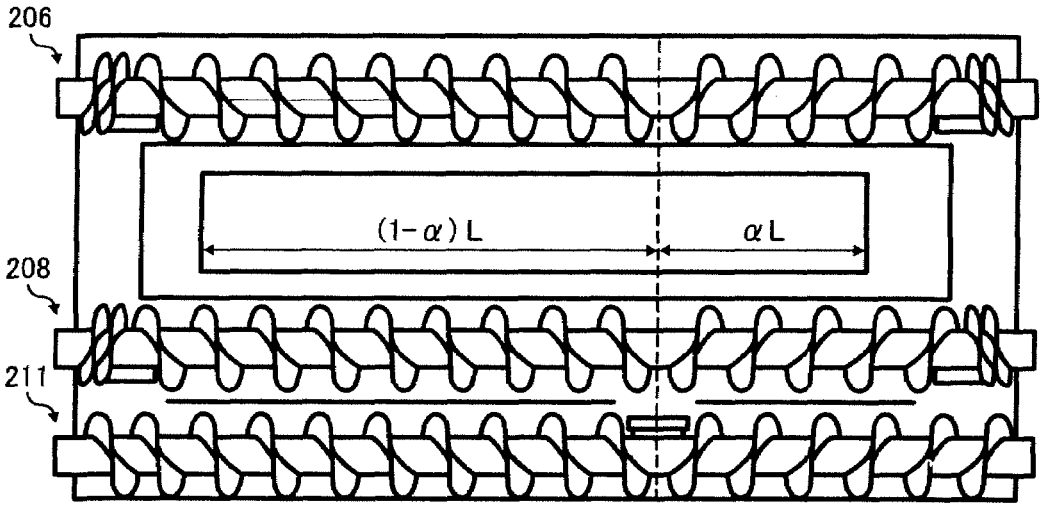
FIG. 1A shows a developing device in which each screw is divided into two areas at a "dividing position".

FIG. 1A shows a developing device in which each screw is divided into two areas at a "dividing position".

Figure 1B:
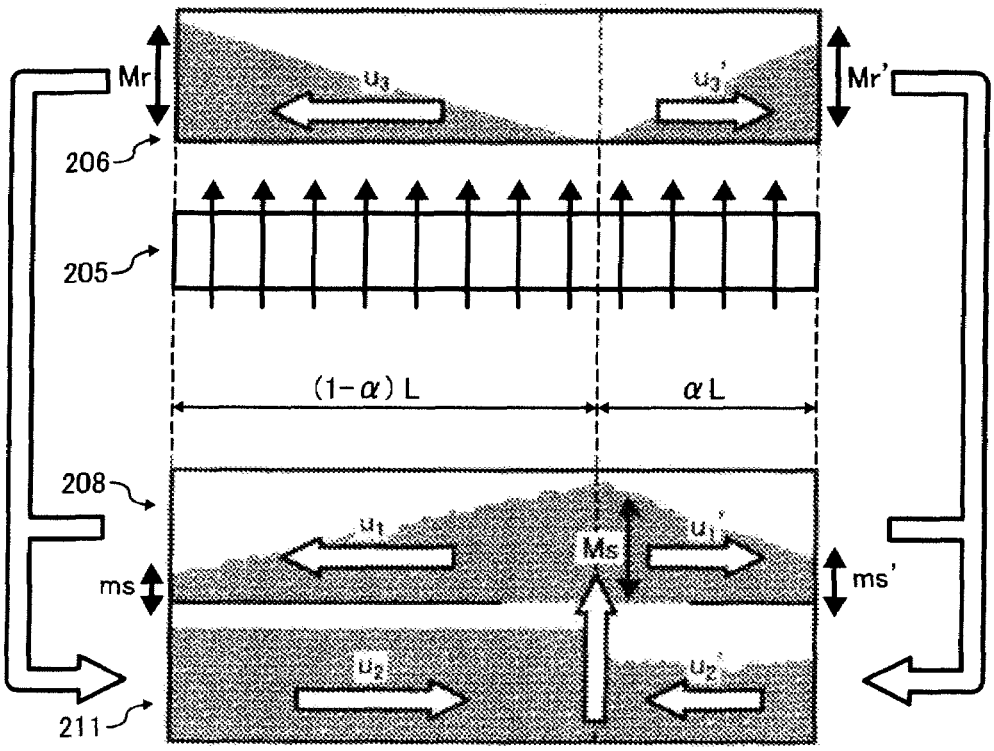
FIG. 1B shows a simplified flow of the developer and a widthwise distribution of the amount of the developer in a developing device in which each screw is divided into two areas at a "dividing position". The ratio of each area in widthwise length is "α" and "(1−α)". The winding direction of the screw in one area is opposite to the winding direction of the screw in a second area.
Figure 22:
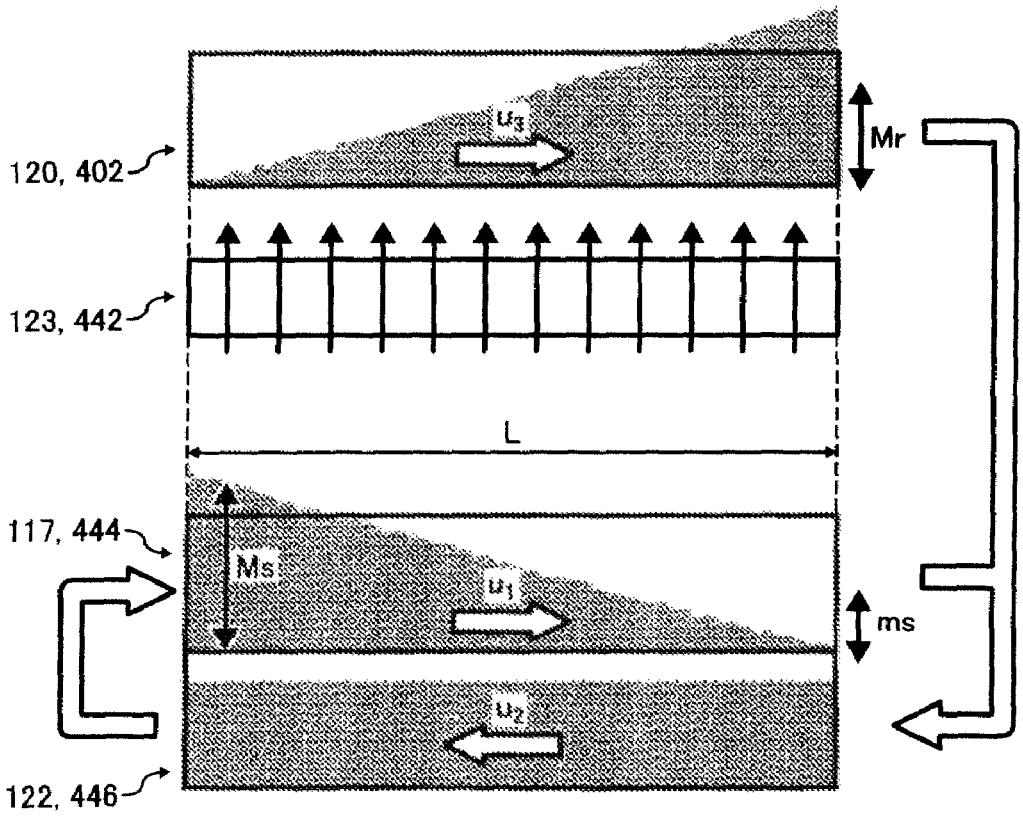
FIG. 22 RELATED ART
FIG. 22 shows the flow of the developer in a conventional developing device including a developer supplying conveyer, a developer receiving conveyer and a developer agitating conveyer.
Figure 23:
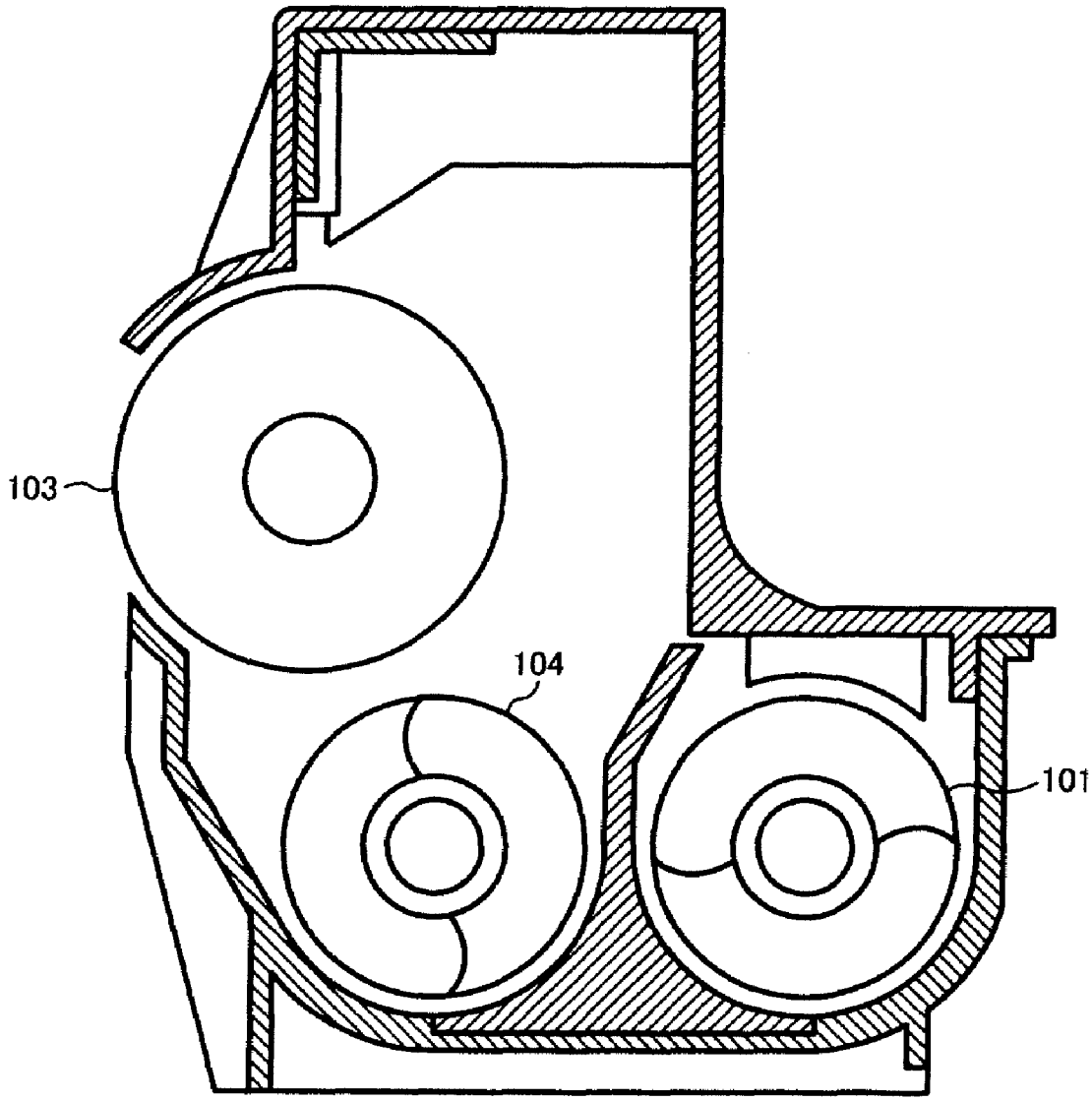
FIG. 23 RELATED ART
FIG. 23 shows a conventional developing device including a developer supplying/agitating member and a developer agitating conveyer.

FIG. 1B shows a simplified flow of the developer and a widthwise distribution of the amount of the developer in a developing device shown in FIG. 1A, in comparison to FIG. 22.

The winding direction of the developer supplying screw, the developer receiving screw and the developer agitating screw is reversed at a point within the development area at which the flow of the developing bearing member is divided into two areas each having the widthwise length $\alpha L$ and the widthwise length $(1-\alpha)L$ wherein $0<\alpha<1$.

Hereinafter, a position at which the conveying direction of the developer reverses may be described as a "dividing position". The "dividing position" is arranged so that if the position is projected to the developer bearing member along the plane which is perpendicular to the widthwise direction of the developer bearing member, the projected position on the developer bearing member is within the area in which the development process is executed.

The weight of the developer per one unit of the length at the downstream end of the screw can be calculated as follows:

$$Mr=\rho v(1-\alpha)L/u3$$

$$ms=Ms-\rho v(1-\alpha)L/u1$$

$$Mr'=\rho v\alpha L/u3'$$

$$ms'=Ms-\rho v\alpha L/u1'$$

Wherein:

Mr: the weight of the developer per one unit of the length at the downstream end of the developer receiving conveyer in the area having the widthwise length $(1-\alpha)L$ ms: the weight of the developer per one unit of the length at the downstream end of the developer supplying conveyer in the area having the widthwise length $(1-\alpha)L$ Mr': the weight of the developer per one unit of the length at the downstream end of the developer receiving conveyer in the area having the widthwise length $\alpha L$ ms': the weight of the developer per one unit of the length at the downstream end of the developer supplying conveyer in the area having the widthwise length $\alpha L$ u3: the speed of the developer conveyed by the developer receiving conveyer in the area having the widthwise length $(1-\alpha)L$ u1: the speed of the developer conveyed by the developer supplying conveyer in the area having the widthwise length $(1-\alpha)L$ u3': the speed of the developer conveyed by the developer receiving conveyer in the area having the widthwise length αL u1': the speed of the developer conveyed by the developer supplying conveyer in the area having the widthwise length αL These equations indicate that reversing the winding direction of the screw (i.e. reversing the conveying direction of the developer) at a point within the development area has the same effect as shortening the value L. Thus, reversing the winding direction of the screw is effective to keep Mr, ms, Mr' and ms' small without enlarging u1, u3, u1' and u3'.

A "dividing position" divides the development area into plural sub-areas. The flow of the developer in each sub-area is approximately separated as if there was a plane between sub-areas. Hereinafter, this imaginary plane will be expressed as Sn (n is a index indicating each imaginary plane). There is only one imaginary plane "S1" in the developing device shown in FIG. 1A and FIG. 1B.

It is preferable that the developer supplying conveyer has the same number of "dividing positions" as that of the developer receiving conveyer.

Some variations of the "dividing position" will be described in FIGS. 2A, 2B, 3A, 3B, 4A, 4B, 5A and 5B. In FIGS. 3A-5B, widthwise lengths of(1−α−β)L, βL, and αL are depicted and are discussed with regard to their "dividing positions" below.

Figure 2A:
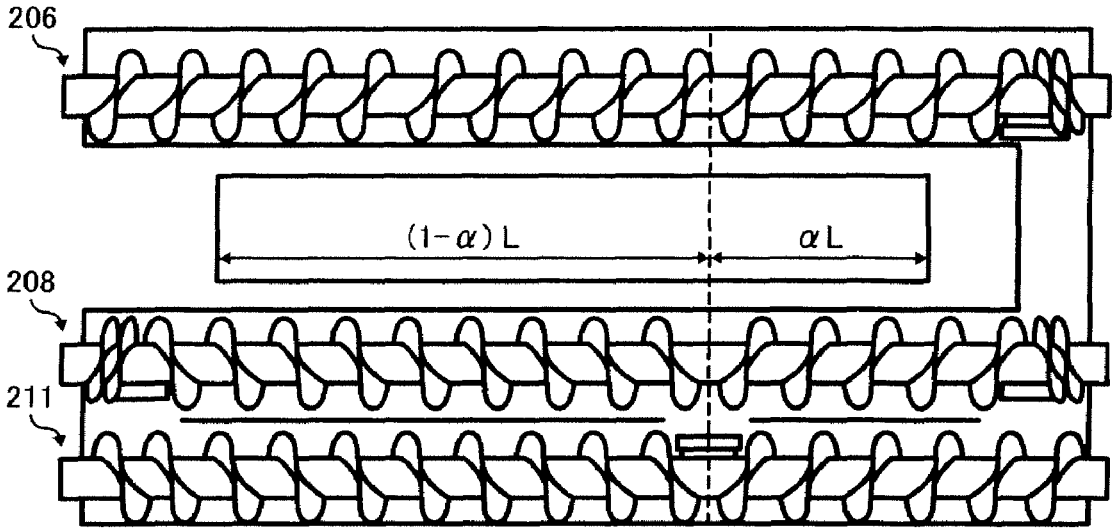
FIG. 2A shows an example of developing device in which the developer supplying conveyer has a "dividing position," but the developer receiving conveyer doesn't have any "dividing position".

(1) FIG. 2A shows an example of developing device in which the developer supplying conveyer has a "dividing position," but the developer receiving conveyer does not have any "dividing position".

Figure 2B:
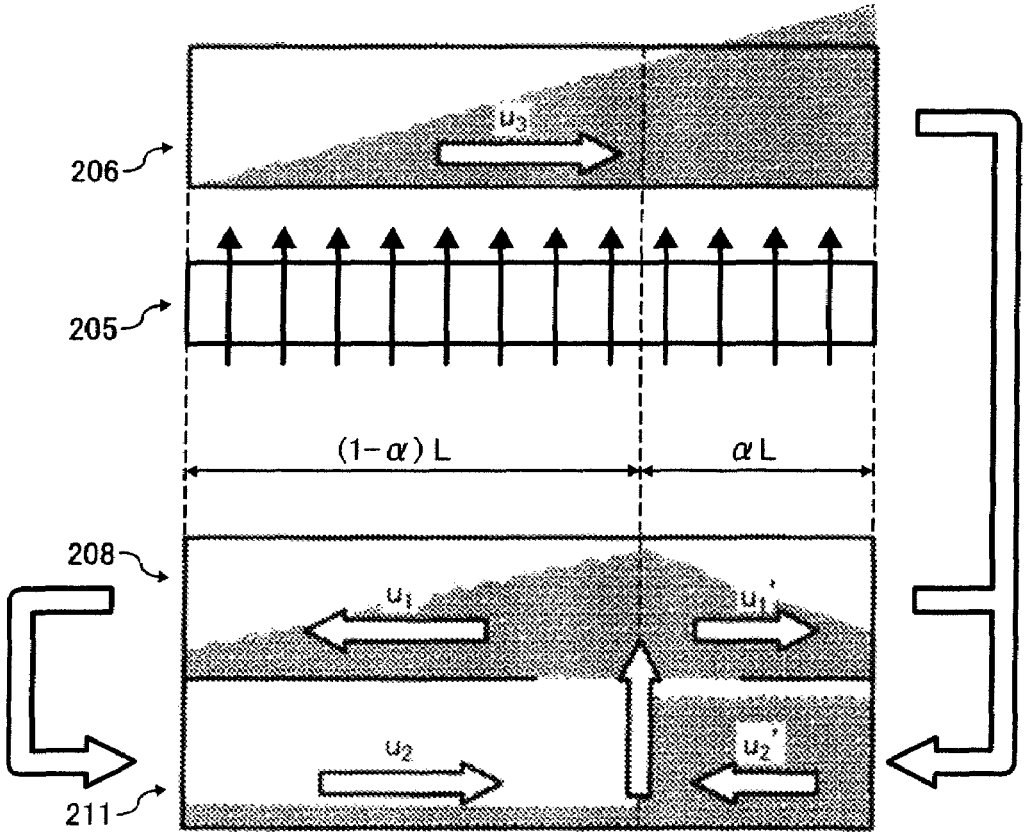
FIG. 2B shows a simplified flow of the developer and a widthwise distribution.

FIG. 2B shows a simplified flow of the developer and a widthwise distribution of the amount of the developer in a developing device shown in FIG. 2A.

Figure 3A:
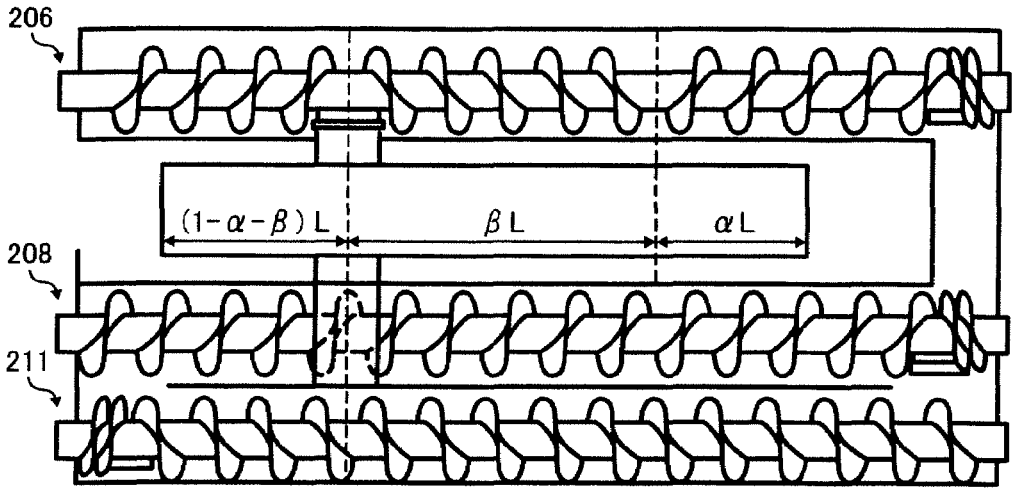
FIG. 3A shows an example of developing device in which the developer receiving conveyer has a "dividing position," but the developer supplying conveyer doesn't have any "dividing position".

(2) FIG. 3A shows an example of developing device in which the developer receiving conveyer has two "dividing positions," but the developer supplying conveyer does not have any "dividing position".

Figure 3B:
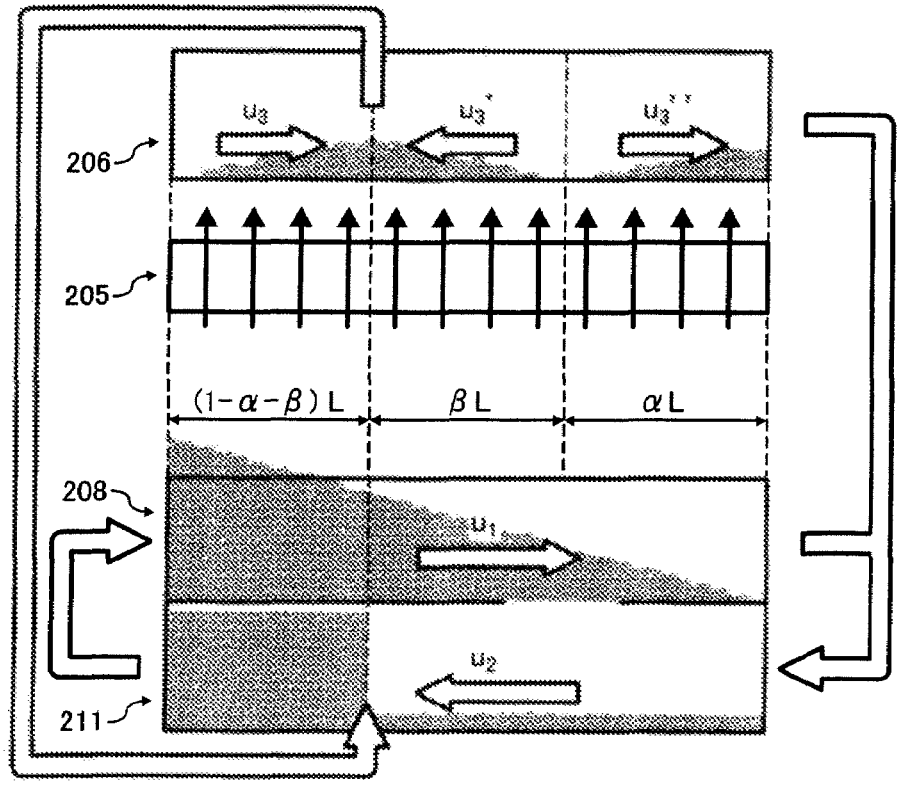
FIG. 3B shows a simplified flow of the developer and a widthwise distribution.

FIG. 3B shows a simplified flow of the developer and a widthwise distribution of the amount of the developer in a developing device shown in FIG. 3A.

Figure 4A:
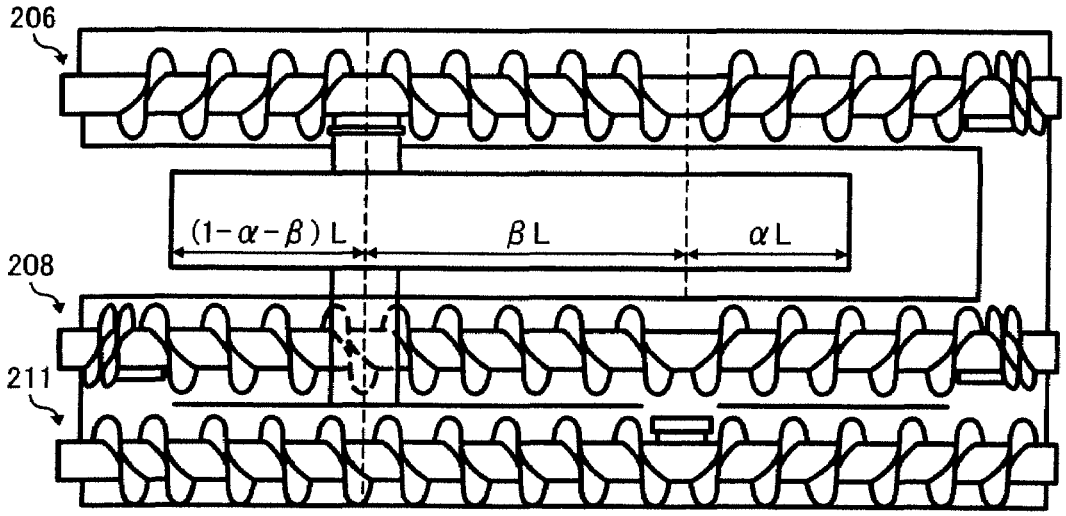
FIG. 4A shows an example of developing device in which the developer receiving conveyer and the developer supplying conveyer each has at least one "dividing position," but the number of the "dividing positions" is different from each other.
Figure 4B:
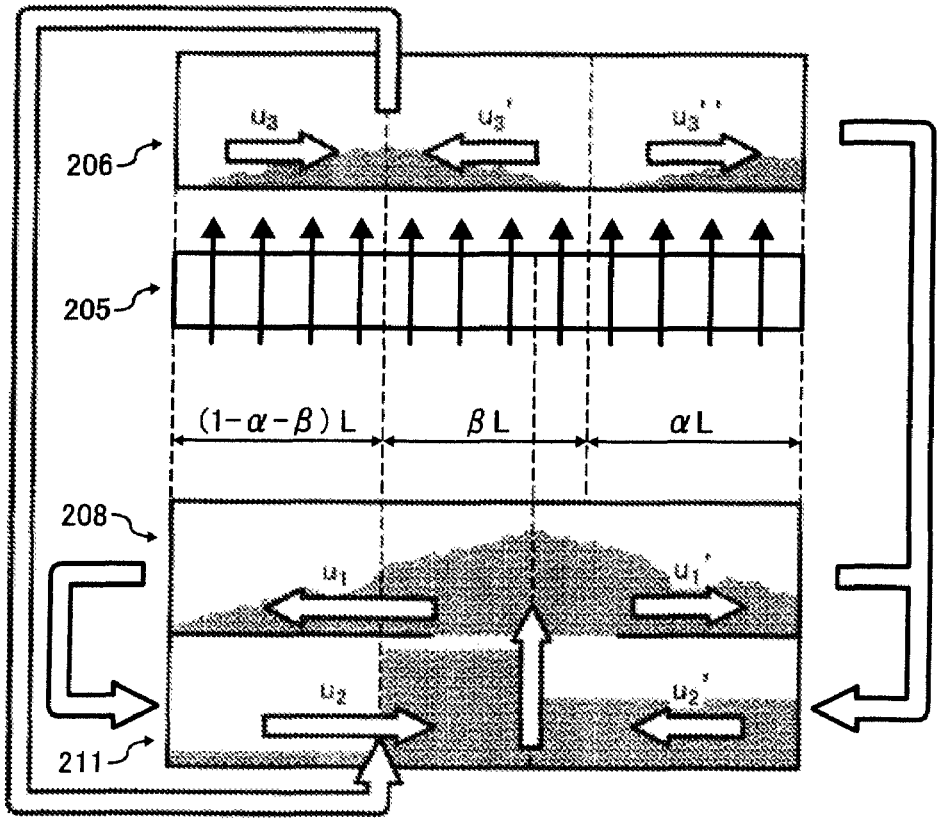
FIG. 4B shows a simplified flow of the developer and a widthwise distribution.

(3) FIG. 4A shows an example of developing device in which the developer receiving conveyer and the developer supplying conveyer each has at least one "dividing position," but the number of the "dividing position" is different from each other. FIG. 4B shows a simplified flow of the developer and a widthwise distribution of the amount of the developer in a developing device shown in FIG. 4A.

As shown in FIGS. 2A, 2B, 3A, 3B, 4A and 4B, if the number of the "dividing position" is different between the developer supplying conveyer and the developer receiving conveyer, the weight of the developer on the developer agitating conveyer per one unit of the length varies immensely in the widthwise direction. The reason for this variation is that the developer agitating conveyer conveys the developer coming from only the downstream of the developer supplying conveyer in one area, and conveys the developer coming from the downstream of both of the developer supplying conveyer and the developer receiving conveyer in another area.

As a result, the space around the developer agitating conveyer is not used efficiently.

Figure 5A:
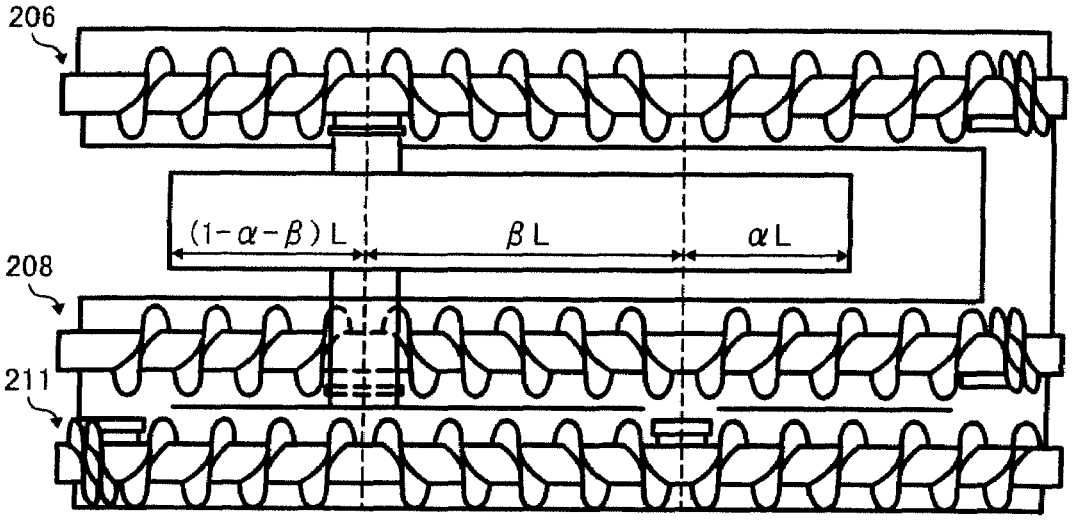
FIG. 5A shows an example of developing device in which the developer receiving conveyer and the developer supplying conveyer each has "dividing positions" and the number of the "dividing positions" is the same.

(4) FIG. 5A shows an example of the developing device in which the developer receiving conveyer and the developer supplying conveyer each has "dividing positions" and the number of the "dividing positions" is the same.

Figure 5B:
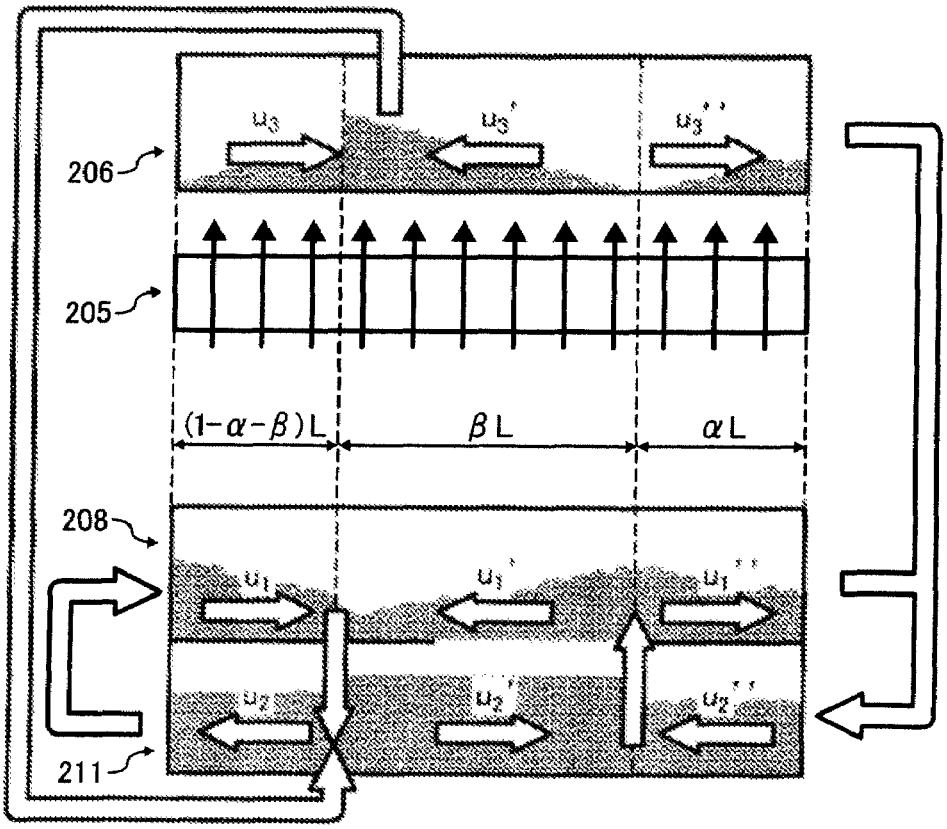
FIG. 5B shows a simplified flow of the developer and a widthwise distribution.

FIG. 5B shows a simplified flow of the developer and a widthwise distribution of the amount of the developer in a developing device shown in FIG. 5A.

Compared with above-mentioned cases (1), (2), and (3), if the number of the "dividing positions" in the developer supplying conveyer and the developer receiving conveyer is the same like case (4), the developer agitating conveyer conveys the developer coming from the downstream of both of the developer supplying conveyer and the developer receiving conveyer in every widthwise point. As a result, the space around the developer agitating conveyer is used efficiently.

Figure 6:
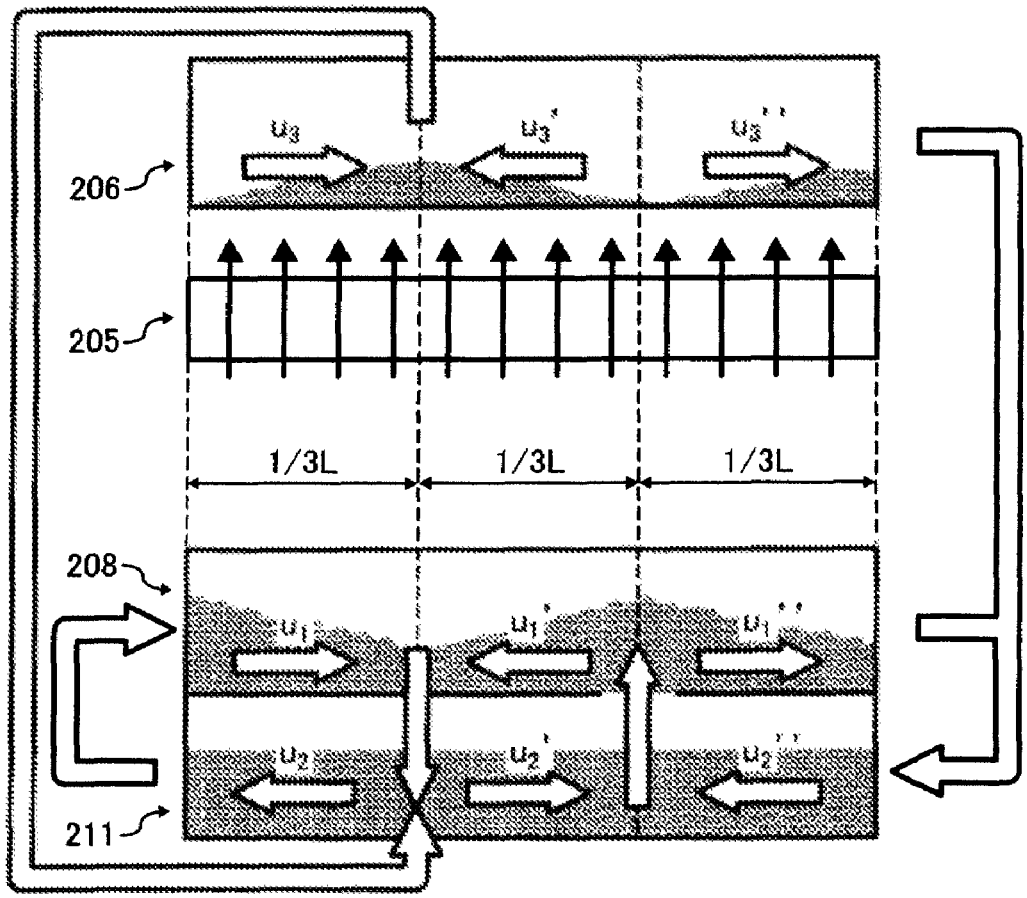
FIG. 6 shows an example of developing device in which "dividing positions" divide the area having the widthwise length L into three sub-areas each having the same widthwise length (=⅓ L) and the speed of the developer is set to be the same in each sub-area.

FIG. 6 shows an example of developing device in which two "dividing positions" divide the area having the widthwise length L into three sub-areas, each having the same widthwise length (=⅓ L). The speed of the developer is set to be the same in each sub-area. In other words, u1=u1'=u1", u2=u2'=u2" and u3=u3'=u3" wherein u1, u1', u1" is the speed of the developer on the developer supplying conveyer in each sub-area, u2, u2', u2" is the speed of the developer on the developer agitating conveyer in each sub-area and u3, u3', u3" is the speed of the developer on the developer receiving conveyer in each sub-area as described in FIG. 6. There are two imaginary planes S1, S2 in FIG. 6.

As a result, the weight of the developer on the developer agitating conveyer per one unit of the length becomes approximately the same at every widthwise point. The maximum and minimum weight of the developer on the developer supplying conveyer per one unit of the length becomes approximately the same at every widthwise point and the maximum weight of the developer on the developer receiving conveyer per one unit of the length becomes approximately the same at every widthwise point.

Thus, the space around each screw can be used with the maximum efficiency.

Figure 7A:
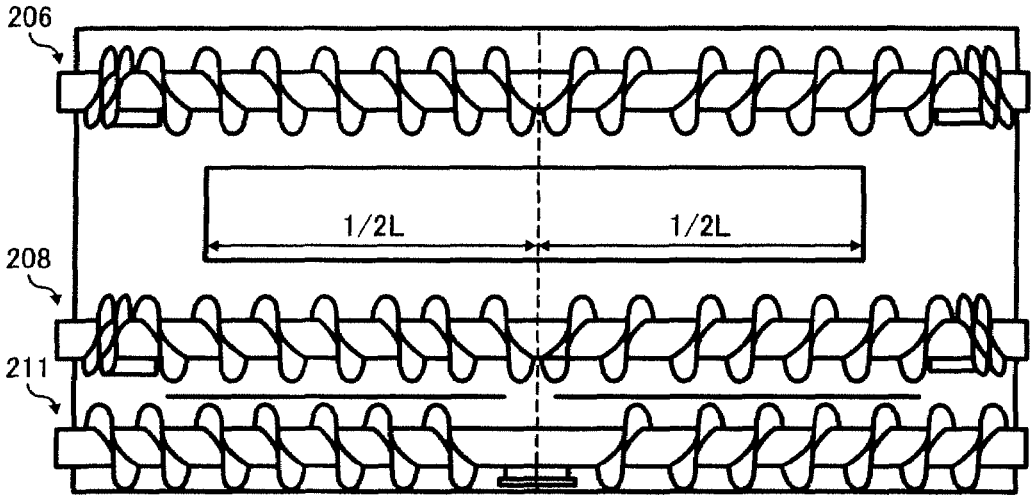
FIG. 7A shows an example of the developing device in which there is only one "dividing position".
Figure 8A:
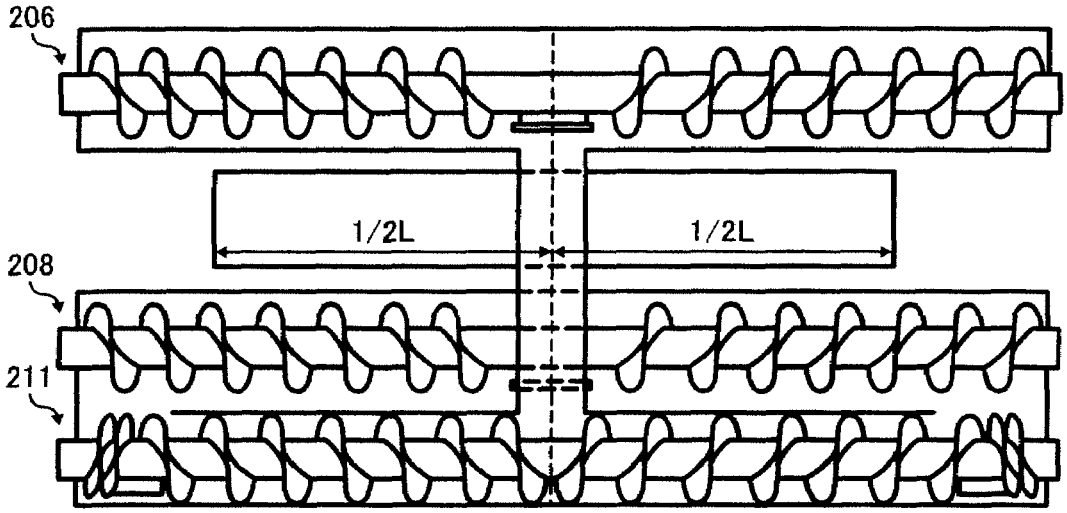
FIG. 8A shows an example of the developing device in which there is only one "dividing position".

(5) FIG. 7A and FIG. 8A show special cases of the developing device explained in (4), in which there is only one "dividing position".

Figure 7B:
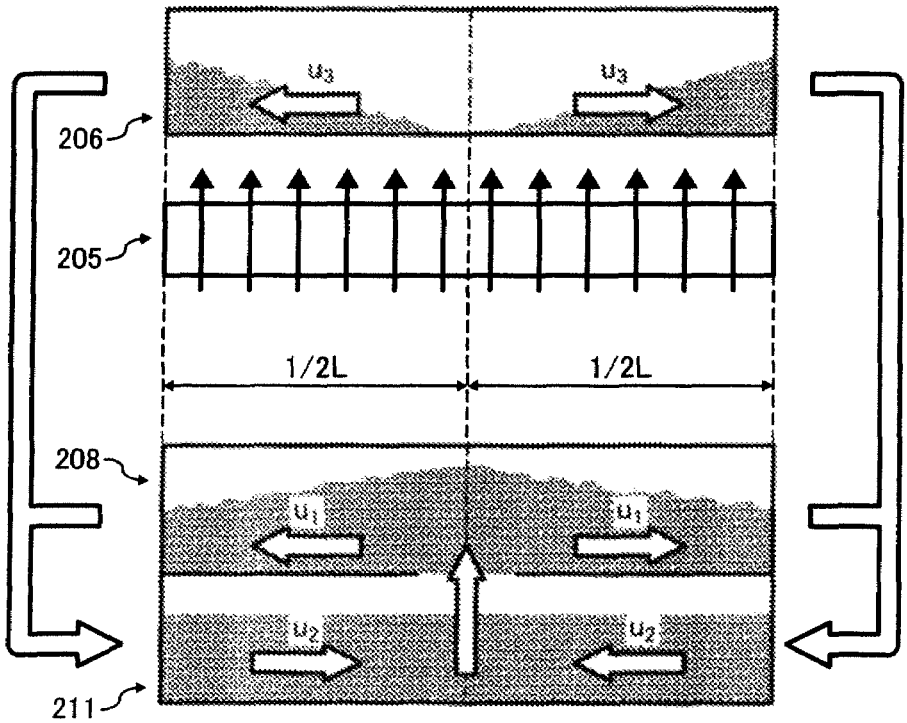
FIG. 7B shows a simplified flow of the developer and a widthwise distribution.

FIG. 7B shows a simplified flow of the developer and a widthwise distribution of the amount of the developer in a developing device shown in FIG. 7A.

Figure 8B:
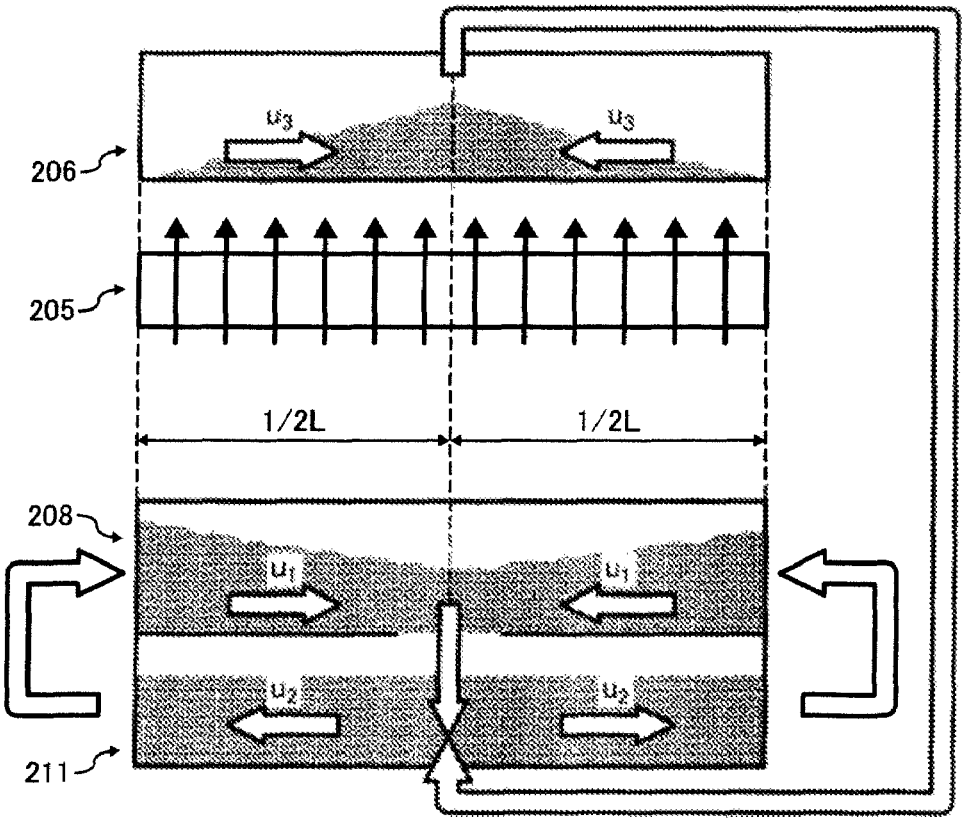
FIG. 8B shows a simplified flow of the developer and a widthwise distribution.

FIG. 8B shows a simplified flow of the developer and a widthwise distribution of the amount of the developer in a developing device shown in FIG. 8A.

This is not only the simplest structure of the developing device explained in (4), but also the most effective structure to make the toner particles spread in the developer since the developer conveying path is the longest.

There is an opening at the center in the widthwise direction of a partitioning board which partitions the developer supplying conveyer from the developer agitating conveyer. The developer moves through the opening.

The conveyance of the developer between the screws can be achieved by a known system such as paddles.

A toner particle replenishment system suitable to the present invention will be described. In the conventional developing device, the toner particles are replenished to one predetermined point on the developer receiving conveyer 206 or the developer agitating conveyer 211. However, it is a problem to have only one toner replenishing point in the developing device in which the circulation of the developer is divided by reversing the winding direction of the screws. If there is only one toner replenishing point, it is difficult to replenish toner particles to a circulation point apart from the toner replenishing point, and there may be fluctuation of the toner density in the widthwise direction on the developer bearing member 205.

Figure 9A:
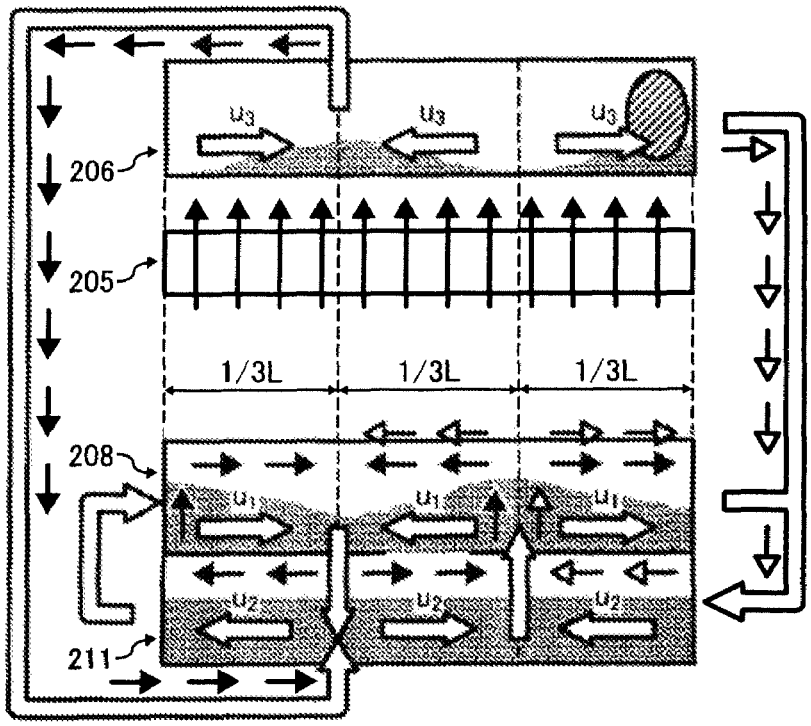
FIG. 9A shows a relationship between the number of toner replenishing points and the amount of toner circulation in case the number of toner replenishing points is smaller than the number of the sub-areas.
Figure 9B:
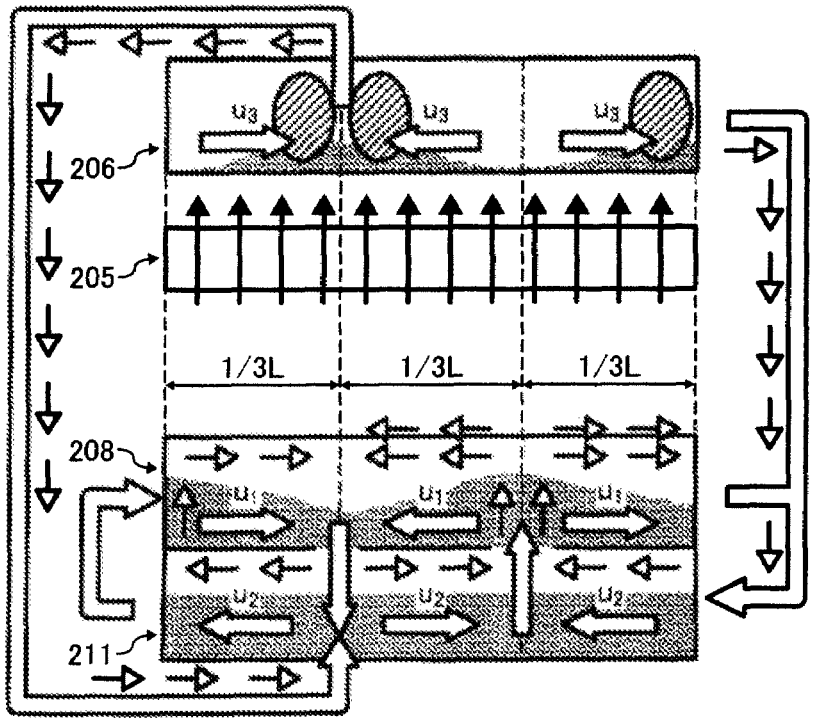
FIG. 9B shows a relationship between the number of toner replenishing points and the amount of toner circulation in case the number of toner replenishing points is equal to the number of the sub-areas.

An example of this problem is shown in FIG. 9A. In FIG. 9A and 9B, the flow of the replenished toner particles is shown by arrows with unfilled triangles and thin lines. Also, the replenishing position is described as a circle filled with a line.

In FIG. 9A, the circulation of the developer is divided into three sub-areas by reversing the winding direction of the screws at two points, but there is only one point for the toner replenishment. Therefore, in the left sub-area placed at the furthest point from the toner replenishing point, the developer after the development with low toner density (shown by arrows with filled triangles and thin lines) reaches the developer bearing member without being mixed well enough with the newly replenished toner particles.

By replenishing toner particles to every sub-area, the newly replenished toner particles can be mixed with the developer well enough in every circulation area as shown in FIG. 9B. It is recommended to replenish the toner particles at functionally similar positions in every circulation area, such as "the downstream of the developer receiving conveyer 206" or "the upstream of the developer agitating conveyer 211", because that will make it easy to control or design the flow of the developer.

By arranging each two positions to which the toner particles are replenished to be disposed symmetrically with respect to a imaginary plane which is disposed between two replenishing positions, the toner particles can be replenished at functionally similar positions.

FIG. 10A through FIG. 10F show the flow of the newly replenished toner particles (shown by arrows with filled triangles and thin lines) in case the toner particles are replenished to each circulation area at the downstream of the developer receiving conveyer 206. The timing for replenishing the toner particles to each one of two replenishing positions is shifted by half of a replenishing period so that the toner particles are replenished alternatively to one of two replenishing positions at a time.

Figure 10A:
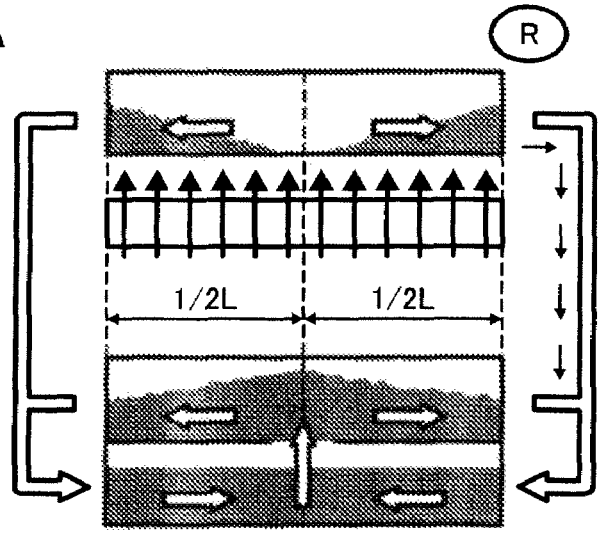
FIG. 10A shows the flow of the newly replenished toner particles in case the toner particles are replenished to each circulation point at the downstream of the developer receiving conveyer at a moment.
Figure 10B:
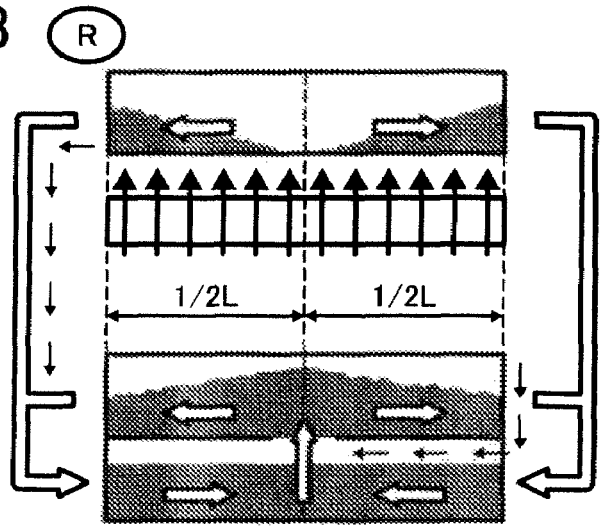
FIG. 10B shows the flow of the newly replenished toner particles in case the toner particles are replenished to each circulation point at the downstream of the developer receiving conveyer at a moment which is half of a replenishing period later than FIG. 10A.
Figure 10C:
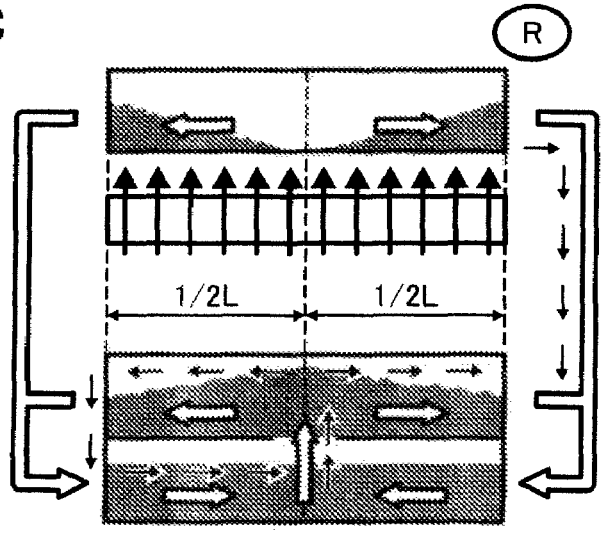
FIG. 10C shows the flow of the newly replenished toner particles in case the toner particles are replenished to each circulation point at the downstream of the developer receiving conveyer at a moment which is half of a replenishing period later than FIG. 10B.
Figure 10D:
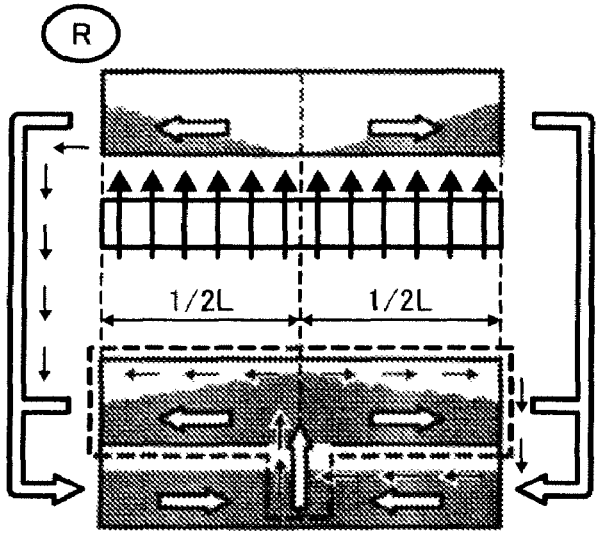
FIG. 10D shows the flow of the newly replenished toner particles in case the toner particles are replenished to each circulation point at the downstream of the developer receiving conveyer at a moment which is half of a replenishing period later than FIG. 10C.
Figure 10E:
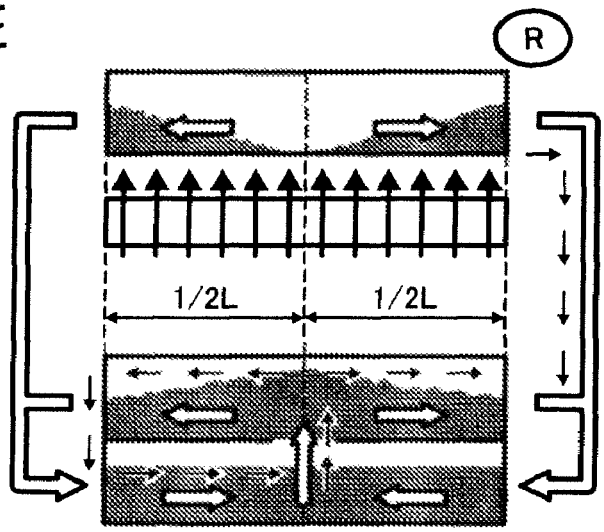
FIG. 10E shows the flow of the newly replenished toner particles in case the toner particles are replenished to each circulation point at the downstream of the developer receiving conveyer at a moment which is half of a replenishing period later than FIG. 10D.
Figure 10F:
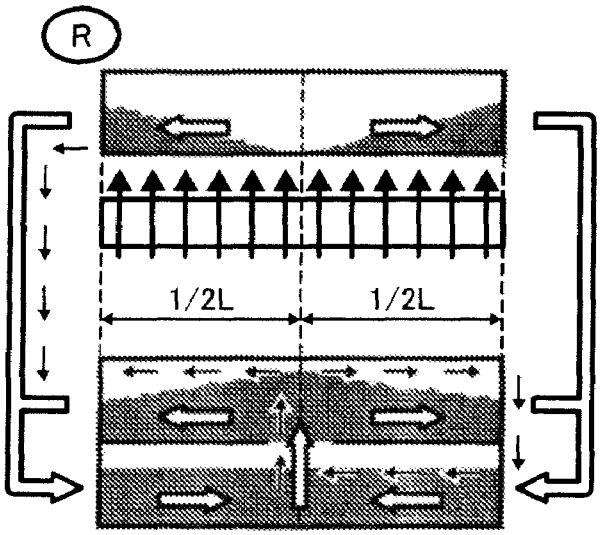
FIG. 10F shows the flow of the newly replenished toner particles in case the toner particles are replenished to each circulation point at the downstream of the developer receiving conveyer at a moment which is half of a replenishing period later than FIG. 10E.

Time passes from FIG. 10A to FIG. 10F so that each figure shows the condition of circulation half of a period after a previous figure. FIG. 10B shows the condition of circulation half of the replenishing period after FIG. 10A. FIG. 10C shows the condition of circulation half of the replenishing period after FIG. 10B. FIG. 10D shows the condition of circulation half of the replenishing period after FIG. 10C. FIG. 10E shows the condition of circulation half of the replenishing period after FIG. 10D. FIG. 10F shows the condition of circulation half of the replenishing period after FIG. 10E. The replenishing position at each timing is shown as "R" in each figure. This control makes the same situation as if the toner particles are continuously replenished to an area surrounded by the dotted lines shown in FIG. 10D. Thus, the fluctuation of the toner density on the developer bearing member 205 can be suppressed efficiently.

Figure 11:
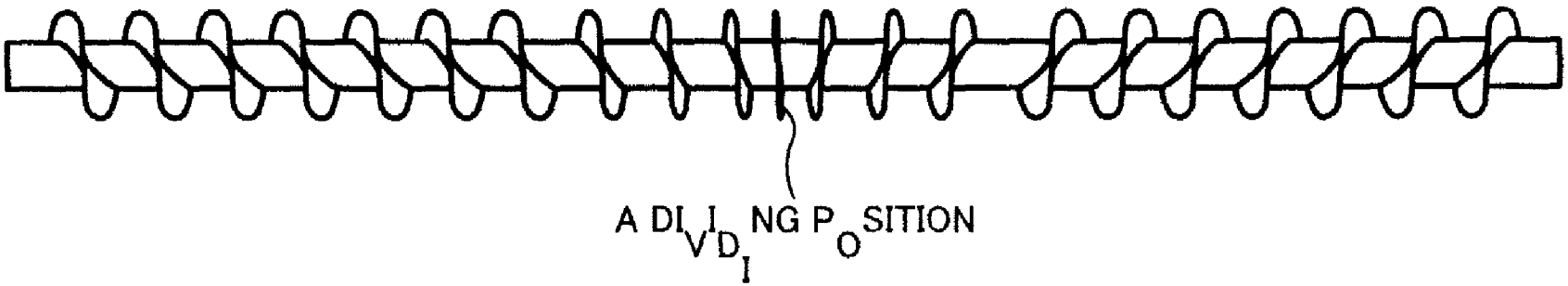
FIG. 11 shows one embodiment of a screw with the winding pitch gradually changing near "A DIVIDING POSITION".

Next, the suitable shape of the screw to the present invention will be discussed. Reversing the winding direction of a screw may cause a collision of the flows of developer conveyed in opposite directions to each other, such as the developer agitating screw 211 in FIG. 7A, the developer supplying screw 208 in FIG. 8A and the developer receiving screw 206 in FIG. 8A. These collisions may increase the stress on the developer. In order to suppress this stress, it is preferable to change the winding pitch of the screw gradually near the "dividing position" so that the winding pitch of the screw at a closer position to the "dividing position" is longer than the winding pitch of the screw at a further position from the "dividing position", as shown in FIG. 11.

If the conveyer does not have a screw form, it is preferable to change the conveying speed of the developer along the conveyer gradually near the "dividing position" so that the conveying speed of the developer at a closer position to the "dividing position" is slower than the conveying speed of the developer at a further position from the "dividing position".

This gradual change of the winding pitch of the screw has another favorable feature when applied to the developer supplying screw 208. It increases the amount of the developer at the downstream of the developer supplying screw.

Figure 12A:
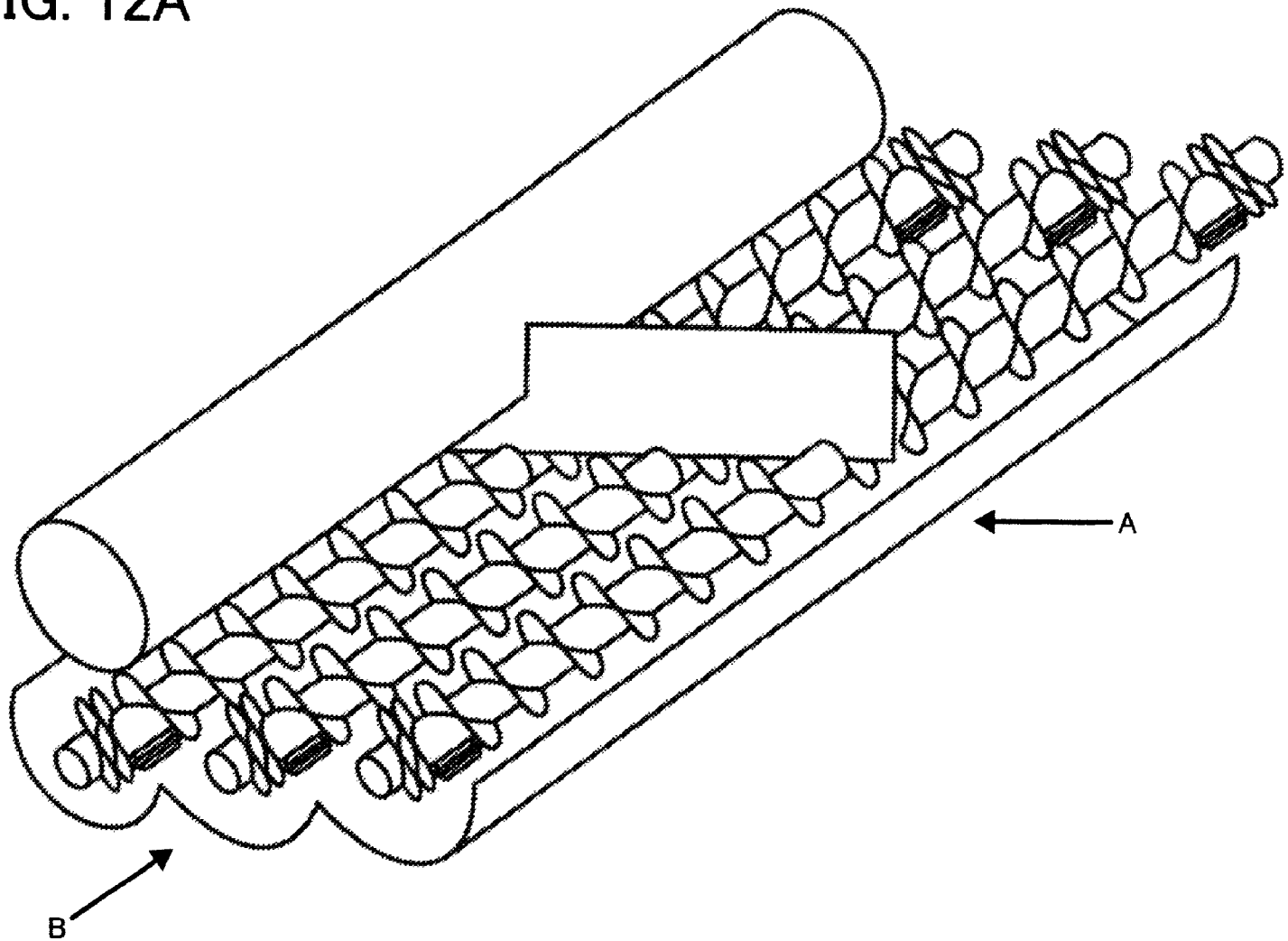
FIG. 12A shows a partitioning member which partitions the development area physically.
Figure 12B:
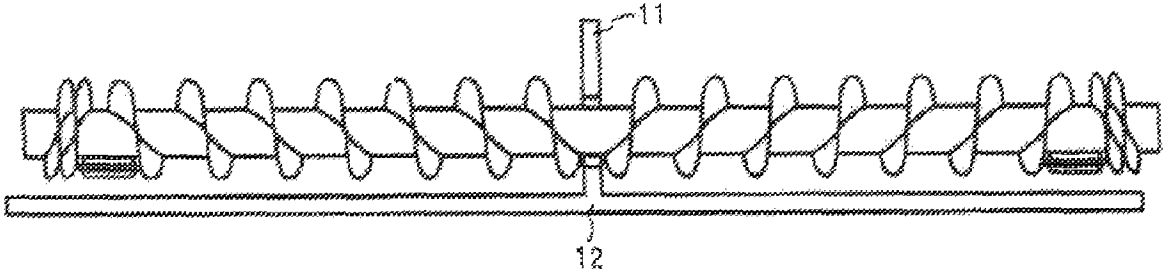
FIG. 12B is a cross section of the developing device seen from the direction of arrow A in FIG. 12A.

Next, a partitioning member which partitions above-mentioned development area (having the length L) into sub-areas will be discussed. This partitioning member physically divides the development area instead of dividing the development area by imaginary planes. In the present invention, the partitioning member can be used as well as the imaginary plane. As an example, the partitioning member has the shape of the planar board as shown in FIG. 12A. The FIG. 12B is a cross section of the developing device seen from the direction of arrow A in FIG. 12A. The FIG. 12C is a cross section of the developing device seen from the direction of arrow B in FIG. 12A.

Figure 12C:
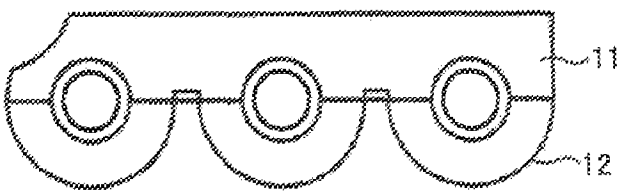
FIG. 12C is a cross section of the developing device seen from the direction of arrow B in FIG. 12A.

The partitioning member comprises an upper part 11 and a lower part 12 as shown in FIGS. 12B and 12C, and screws are put between those two parts. This structure makes it easy to construct the partitioning member in the developing device. The holes in the partitioning member through which screws go have a diameter slightly greater than the diameter of screws to suppress the friction between the partitioning member and screws. Sponges are put between the partitioning member and screws.

Next, the developing device to which the present invention applies will be discussed. The present invention can be applied not only to the developing device in this embodiment as shown FIG. 19, but also to the conventional developing device as shown in FIG. 20 or FIG. 21.

FIG. 19 shows the developing device in which the developer receiving conveyer, the developer supplying conveyer and the developer agitating conveyer are arranged so that the three conveyers lines approximately horizontally.

Figure 20:
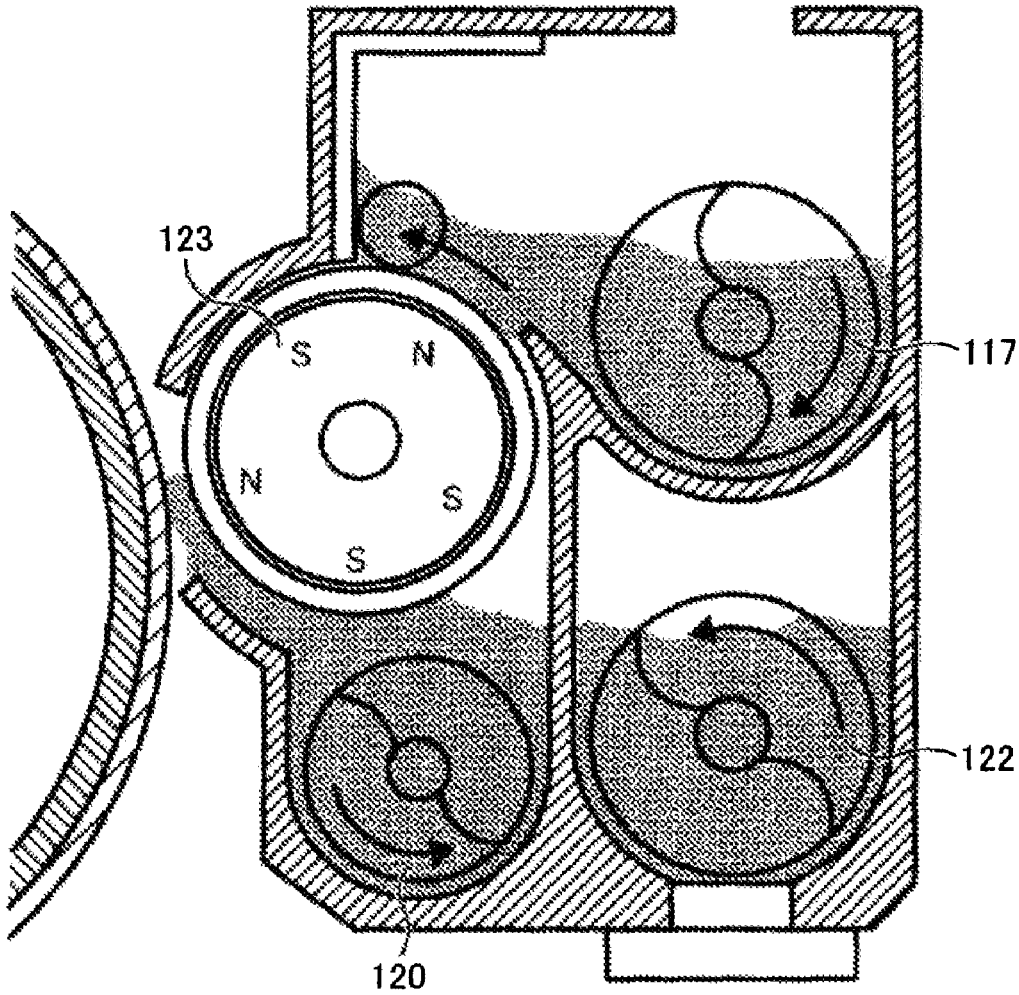
FIG. 20 RELATED ART
FIG. 20 shows a conventional developing device including a developer supplying conveyer, a developer receiving conveyer and a developer agitating conveyer.

FIG. 20 shows the developing device in which the center axis of the developer agitating conveyer is disposed lower than the center axis of the developer receiving conveyer, and the center axis of the developer receiving conveyer is disposed lower than the center axis of the developer bearing member.

Figure 21:
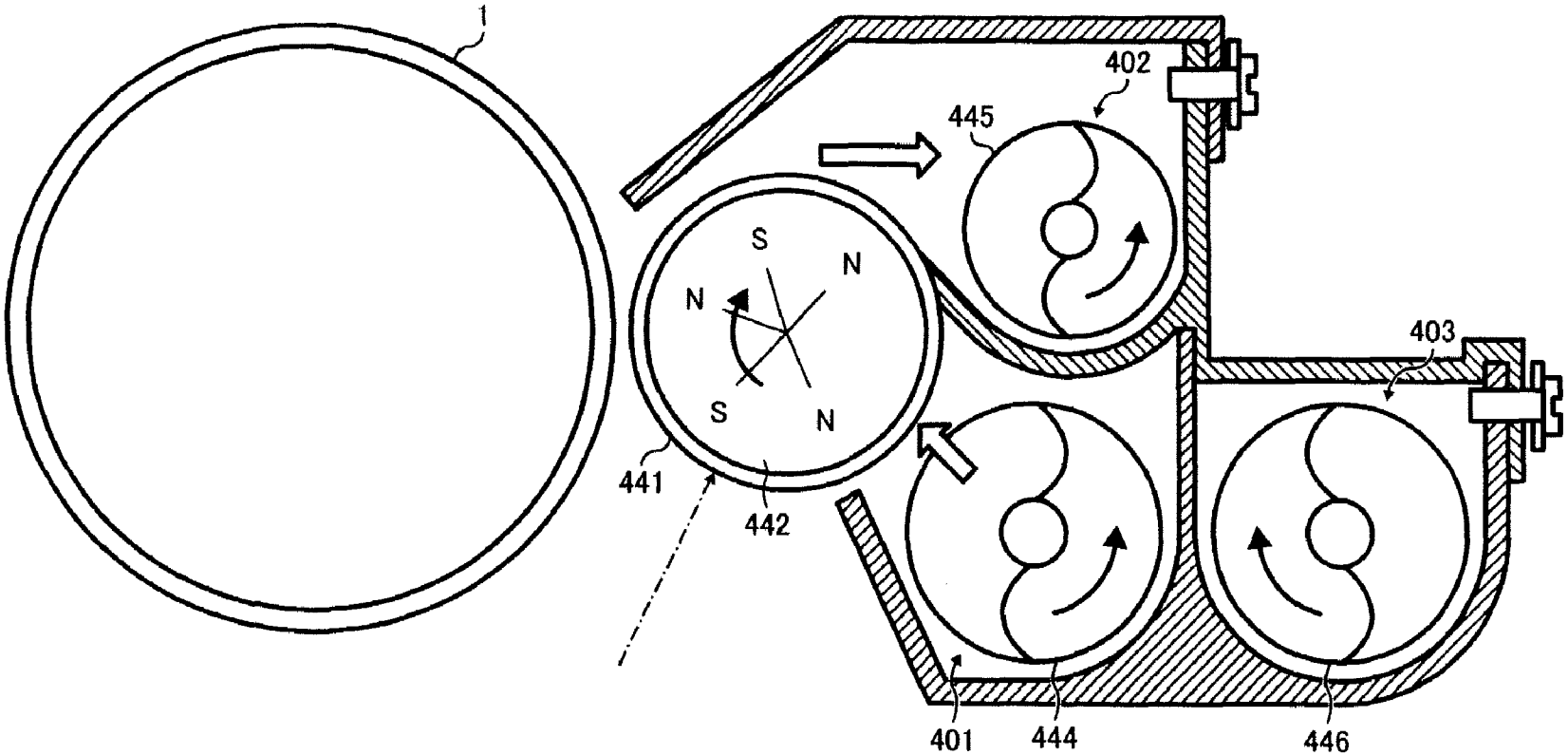
FIG. 21 RELATED ART
FIG. 21 shows a conventional developing device including a developer supplying conveyer, a developer receiving conveyer and a developer agitating conveyer.

FIG. 21 shows the developing device in which the center axis of the developer supplying conveyer is disposed lower than the center axis of the developer bearing member, the center axis of the developer supplying conveyer is disposed approximately as high as the center axis of the developer agitating conveyer and the center axis of the developer receiving conveyer is disposed higher than the center axis of the developer agitating conveyer.

Figure 13:
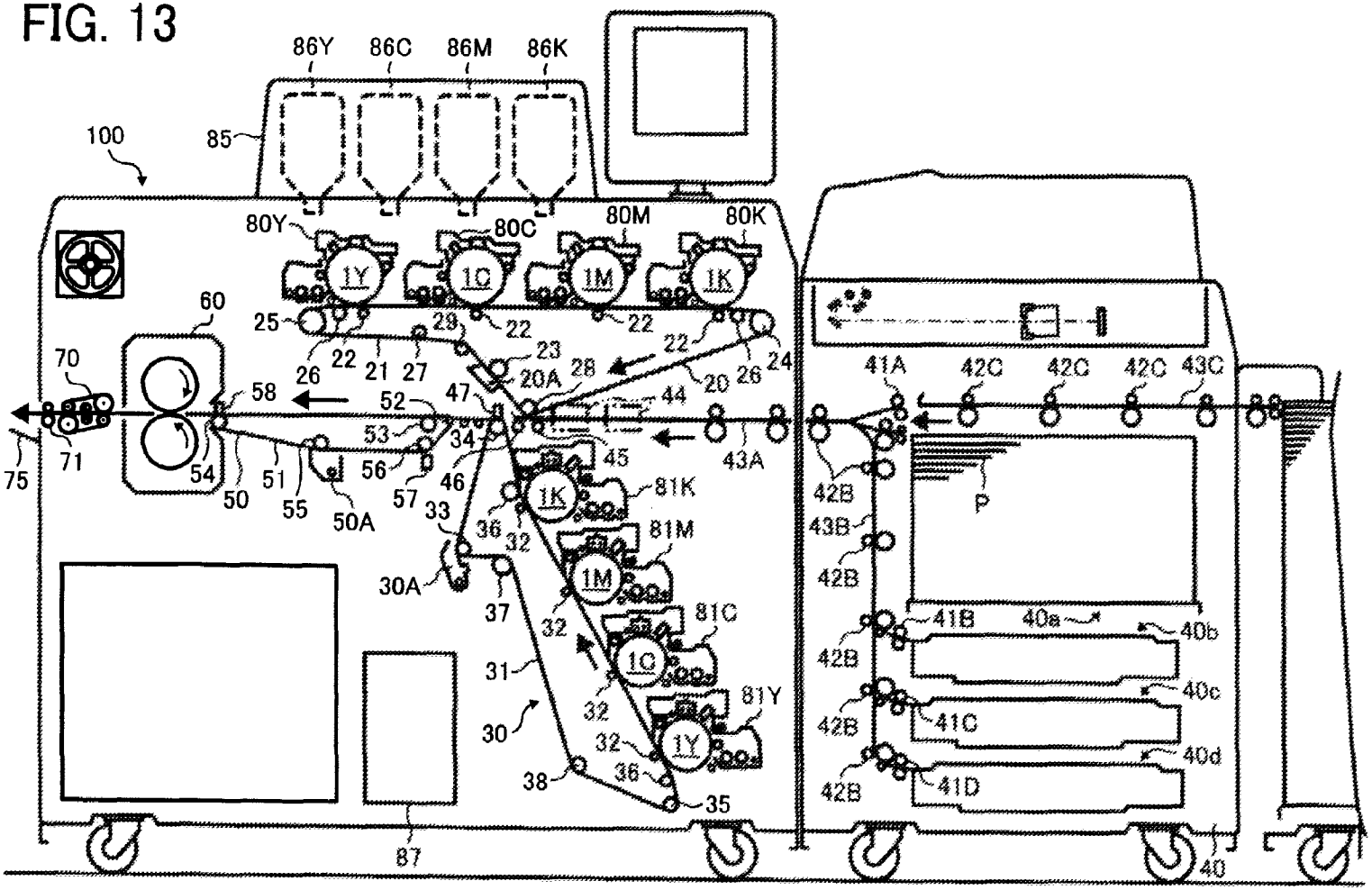
FIG. 13 shows a cross section of an image forming apparatus to which the present invention can be applied.

The image forming apparatus in this embodiment is illustrated in FIG. 13. Each element of this image forming apparatus will be discussed first, and the motion of this image forming apparatus will be discussed next.

FIG. 13 shows the cross section of the image forming apparatus 100 to which the present invention is applied.

FIG. 13 shows the configuration of a full color printer capable of double-faced printing by electrophotography, with the image formation apparatus related to the present embodiment labeled as 100.

As shown in the figure, the primary image formation part 20 is positioned above, and the second image formation part 30 is positioned below, the recording medium feed path 43A within the main body 100 of this image formation apparatus. The primary image formation part 20 is provided with a first intermediate transfer belt 21 moving endlessly in the direction of the arrow, and the second image formation part 30 is provided with a second intermediate transfer belt 31 moving endlessly in the direction of the arrow. Four first image formation units 80Y, 80C, 80M, and 80K are positioned on the upper tensioned face of the first intermediate transfer belt 21. On the other hand, four second image formation units 81Y, 81C, 81M, and 81K are positioned on the upper tensioned face of the second intermediate transfer belt 31. The designations Y, C, M, and K are associated with the numbers of these primary and second image formation units corresponding to the colors of toner handled, Y corresponding to yellow, C to cyan, M to magenta, and K to black. The same Y, C, M, and K are applied to photoconductors (latent image bearing members) 1 which are provided in the first or second image formation units and rotate together with the first intermediate transfer belt 21 or second intermediate transfer belt 31. The photoconductors 1Y through 1K are positioned equidistantly within the image formation parts 20 and 30, and in contact with at least part of the upper tensioned face of the intermediate transfer belts 21 and 31 respectively during image formation.

Figure 14:
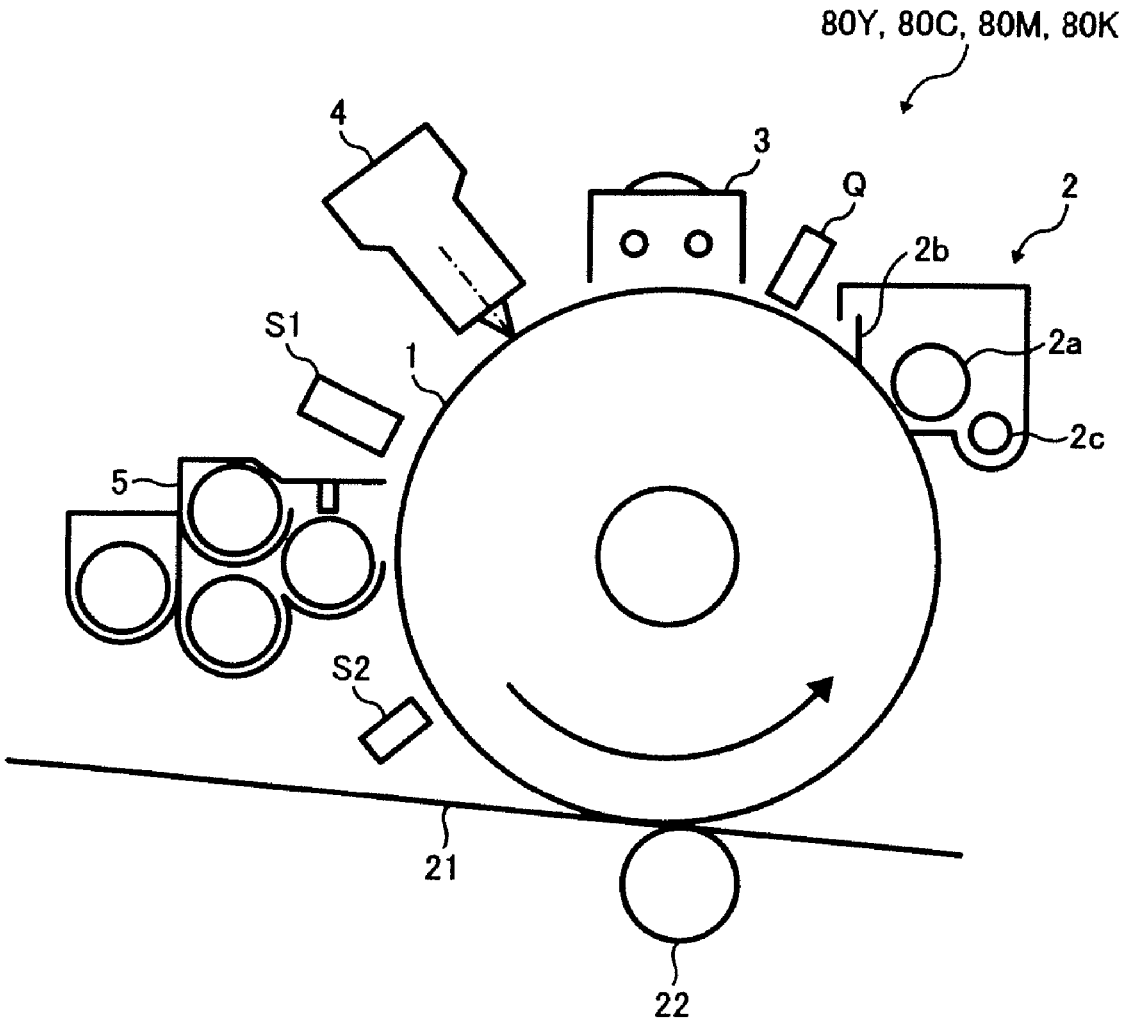
FIG. 14 shows a main portion of the image formation part to which the present invention can be applied.

The main portion of the image formation part is shown in FIG. 14.

In FIG. 14, the cylindrical photoconductor 1 is driven by a drive device (not shown) to rotate in the direction of the arrow when the printer part 100 is operated. Image formation devices, such as a scorotron charger (a charging device) 3, an optical writing device 4, a developing device 5, a cleaning device 2, a discharger Q, etc., and an electric potential sensor S1 and an image sensor S2 are arranged around the photoconductor 1.

The photoconductor 1 includes an aluminum cylinder whose diameter may be from 30 mm to 120 mm, the surface of which is covered with a layer of photoconductive material, such as an organic photoconductive (OPC) layer. The first photoconductor 1 may be an aluminum cylinder covered with an amorphous silicon (a-Si) layer. Further, the first photoconductor 1 may be formed as a belt.

The cleaning device 2 includes a cleaning brush 2*a*, a cleaning blade 2*b*, a collecting member 2*c*, etc., and is configured to remove and to collect residual toner remaining on the surface of the photoconductor 1.

The optical writing device 4 radiates light beams on the electrically charged surface of the photoconductor according to the image data of each color in order to discharge the electrical charge and form the electrical latent image.

In the shown example, the optical writing device 4 is formed of a light emitting diode (LED) array and a focusing element. A known laser scan system using a laser light source, a polygon mirror, and the like can be also used as the optical writing device 4.

Instead of the scorotron charger 3, another type of charging device can be used. For example, a charging roller in contact with the surface of the photoconductor 1 can be used.

The developing device 5 develops latent images to toner images by developing discharged areas of latent images. A two-component developer including toner particles and carrier particles is used. The detail of the developing device 5 has been discussed in FIG. 19.

The photoconductor 1 is uniformly charged to a negative polarity by the scorotron charger 3. The area on the photoconductor 1 to be developed is discharged by beams from the optical writing device 4 and developed by the developing device 5 with the toner particles with negative polarity.

Next, description will be made of the intermediate transfer belt.

As the primary intermediate transfer body, the first intermediate transfer belt 21 is supported by a plurality of rollers 23, 24, 25, 26 (two), 27, 28, and 29 running in the direction of the arrow, and provided at the bottom of the photoconductors 1Y, 1C, 1M, and 1K in the first image formation units 80Y through 80K. This first intermediate transfer belt 21 is endless, and is tensioned and positioned so that it is in contact with part of each photoconductor after the developing process.

Furthermore, the primary transfer rollers 22 are provided on the inner periphery of the first intermediate transfer belt 21 opposite the photoconductors 1Y, 1C, 1M, and 1K. The cleaning apparatus 20A is provided at a position opposite to the roller 23 on the outer periphery of the first intermediate transfer belt 21. This cleaning apparatus 20A wipes and removes excess toner and recording medium dust and the like remaining on the surface of the first intermediate transfer belt 21.

The first intermediate transfer belt 21, the first image formation units 80Y, 80C, 80M, and 80K, and the cleaning apparatus 20A are integrated to comprise the first image formation unit 20 being removable from the image formation apparatus 100.

On the other hand, the second intermediate transfer belt 31 corresponding to a second intermediate transfer body is supported by a plurality of rollers 33, 34, 35, 36 (two), 37, and 38 running in the direction of the arrow. This second intermediate transfer belt 31 is endless, and is tensioned and positioned so that it is in contact with the photoconductors 1Y, 1C, 1M, and 1K in the second image formation units 81Y through 81K.

This second intermediate transfer belt 31 is endless, and is tensioned and positioned so that it is in contact with part of each photoconductor after the developing process. The primary transfer rollers 32 are provided on the inner periphery of the second intermediate transfer belt 31 opposite the photoconductors 1Y, 1C, 1M, and 1K.

The cleaning apparatus 30A is provided at a position opposite to the roller 33 on the outer periphery of the second intermediate transfer belt 31. This cleaning apparatus 30A wipes and removes excess toner and recording medium dust and the like remaining on the surface of the intermediate transfer belt 31.

The second intermediate transfer belt 31, the second image formation units 81Y, 81C, 81M, and 81K, and the cleaning apparatus 30A are integrated to comprise the second image unit 30 being removable from the image formation apparatus 100.

A transfer roller 46 is arranged at outer periphery of the first intermediate transfer belt 21 and close to the supporting roller 28. Toner images on the first intermediate transfer belt 21 are transferred a recording medium P by an electric bias applied to the roller 46 while the recording medium P passes between the first intermediate transfer belt 21 and the transfer roller 46.

A transfer charger 47 is arranged at outer periphery of the second intermediate transfer belt 31 and close to the supporting roller 34. The transfer charger 47 may be of a known type in which a discharge electrode of a thin tungsten or gold wire is held within a casing and a transfer bias is applied to the discharge electrode by the electric source (not shown).

Toner images on the second intermediate transfer belt 31 are transferred to a recording medium P by the transfer current is applied to the discharge electrode while the recording medium P passes between the second intermediate transfer belt 31 and the transfer charger 47.

The polarity of the transfer bias applied to the transfer roller 46 and transfer charger 47 is positive, opposite to that of the toner.

The recording medium supply apparatus 40 enclosing a supply of recording media is positioned at the right of the image formation apparatus 100 and feeds recording media to the recording medium path 43B and 43A. One sheet is fed at a time by a plurality of pairs of feed rollers 42B.

A recording medium transport device 50 is provided to feed a recording medium having passed through the second transfer position on the extension of the recording medium feed path 43A up to the fixing nip in the fixing apparatus 60 provided downstream in the recording medium feed direction while maintaining it in a flat condition. The recording medium transport device 50 has rollers 52, 53, 54, 55 and 56 supporting the endless feed belt 51 transporting the recording medium in the direction of the arrow.

A cleaning apparatus 50A is provided opposite to the roller 55, a suction charger 57 to grip the recording medium P is provided opposite the roller 56, and a discharging/separation charger 58 are provided opposite the roller 54, on the outside of the feed belt 51.

The feed belt 51, contacting an unfixed toner image and moving with the recording medium P, is electrically charged by the suction charger 57 with the same negative polarity as the toner particles. The feed belt 51 can be metal belt, polyimide belt or polyamide belt as long as the resistivity value is suitable to be charged. The feed belt 51 is configured to release the toner images. The moving speed of the feed belt 51 is set to be the same speed as the speed of a recording medium passing through the fixing apparatus 60.

The fixing apparatus 60 having a heating device is provided downstream in the direction of the recording medium transport device 50. Possible heating devices include a heater provided within a roller, a belt fixing apparatus running a heated belt, or a fixing apparatus wherein induction heating is employed as the heating method. Material, hardness, and a surface nature of the fixing rollers and fixing belts is made the same top and bottom to ensure the same hue and glossiness of the images on both faces of the recording medium. Furthermore, fixing conditions are controlled according to an image forming condition, such as full color or monochrome images, single or double-faced operation, or according to recording medium type, by a control device (not shown) to ensure that fixing conditions are optimized. A pair of cooling rollers 70 having a cooling function are provided in the feed path after fixing in order to cool the recording medium for which fixing is complete, and to stabilize unstable toner as soon as possible. Rollers of a heat-pipe construction having a heat spreader can be employed as this pair of cooling rollers 70. The cooled recording medium is discharged from the image formation apparatus 100 to the recording medium stack tray 75 by the pair of ejecting rollers 71.

The recording medium stack tray 75 employs a mechanism in which a receiving member is moved by an elevator mechanism (not shown) upward and downward according to the height of stacked recording mediums. A separate recording medium processing apparatus may be arranged so that the recording medium P is conveyed thereto passing the recording medium stack tray 75 to the recording medium processing apparatus. As the recording medium processing apparatus, a bookbinding apparatus performing punching, cutting, folding, binding, etc. may be provided.

The toner bottles 86Y, 86C, 86M, and 86K, containing unused toner particles of respective colors and carrier particles, are detachably accommodated in the bottle accommodation part 85. The toner particles are supplied as necessary to each development device by a toner supply mechanism.

In this embodiment, each of the toner bottles 86, 86C, 86M, and 86K supplies toner to respective development devices of the first image formation part 80 and the second image formation part 81, using the same toner. However, separate toner bottles may be provided for supplying toner of respective colors to the development devices of the first image formation part and the second image formation part. Further, the toner bottle 86K containing frequently consumed black toner may be configured to contain a large volume of toner.

The bottle accommodation part 85 is arranged at the depth side of the printer part 100, and a flat surface part in front of the bottle accommodation part 85 and at the upper surface of the printer 100 is provided to serve as a working table.

Single-faced recording operation wherein a full color image is formed on one face of the recording medium P in the image formation apparatus 100 will be described below.

The single-faced recording method is basically of two types, either of which may be selected. One of the two types is a method whereby the image carried by the first intermediate transfer belt 21 is transferred directly to upper face of the recording medium, and the other is a method whereby the image carried by the second intermediate transfer belt 31 is transferred directly to lower face of the recording medium.

When there are plural pages of image data to be formed, it is preferable to control the order of pages so that recording mediums are discharged on the recording medium stack tray 75 with correct order of pages.

The method whereby the image is carried by the first intermediate transfer belt 21 and transferred to the recording medium will be described below. The larger-numbered page is formed earlier than the smaller-numbered page so as to the order of the page is controlled appropriately.

When the image formation apparatus 100 is operated, the first intermediate transfer belt 21, and the photoconductors 1Y, 1C, 1M, and 1K in the first image formation units 80Y through 80K, rotate. The second intermediate transfer belt 31 rotates simultaneously. However, the photoconductors 1Y, 1 C, 1M, and 1 K in the second image formation units 81Y through 81K are separated from the second intermediate transfer belt 31 and do not rotate.

First, operation begins with image formation with the image formation unit 80Y. A Y color toner image is formed on the photoconductor 1Y by the following process. The photoconductor 1Y is uniformly charged with a negative polarity by the scorotron charger 3. The area on the photoconductor 1Y to be developed is discharged by beams from the optical writing device 4, according to the image data for yellow color, and an electrical latent image is formed on the photoconductor 1Y. Then, the latent image is developed to a toner image by the developing device 5 with the toner particles having negative polarity. This Y color toner image formed on the photoconductor is primary-transferred to the first intermediate transfer belt 21 moving synchronously with the photoconductor 1Y by the transfer action of the primary transfer rollers 22. In the same manner, primary transfer operation is also conducted in sequence with the appropriate timing for the photoconductors 1C, 1M, and 1K.

Thus, a full color toner image wherein the yellow, cyan, magenta, and black toner images are overlapped in sequence is carried on the primary intermediate transfer belt 21. This full color toner image is moved with the primary intermediate transfer belt 21 in the direction of the arrow in the figure.

Simultaneously, the recording medium P used for recording is fed from the recording medium supply tray 40*a* or a recording medium cassette 40*b*, 40*c*, and 40*d* in the recording medium supply apparatus 40 by one of the recording medium supply and separation devices 41A, 41B, 41C, and 41D. The recording medium is then fed to the recording medium feed path 43C by the pair of feed rollers 42B and 42C. Prior to the leading edge of the recording medium being gripped by the pair of registration rollers 45, the horizontal registration compensation mechanism 44 is slid so that it is pressed against the reference guide horizontal in relation to the recording medium feed direction in order to align the recording medium in the horizontal direction. The recording medium is temporarily halted by the pair of registration rollers 45 and again fed to the transfer area with the appropriate timing to ensure that the recording medium is in the correct position in relation to the image on the primary intermediate transfer belt 21.

The full color toner image on the primary intermediate transfer belt 21 is transferred by the transfer action of the first secondary transfer roller 46 to the upper surface of the recording medium P fed synchronously with the primary intermediate transfer belt 21. The bias provided to the first secondary transfer roller 46 is positive (opposite of toner charging polarity). Following transfer, the surface of the primary intermediate transfer belt 21 is cleaned with the belt cleaning apparatus 20A. Furthermore, foreign matter such as toner and the like remaining on the surface of the photoconductors 1Y, 1C, 1M, and 1K in the first image formation units 80Y through 80K for which primary transfer is complete is removed with the cleaning brush 2*a* and the cleaning blade 2*b* in the cleaning apparatus 2.

The surface of each photoconductor is discharged by the discharger Q for the next image formation. Removed matter such as toner and the like is sent to the gathering box 87 by collecting member 2*c*. The electric potential sensor S1 and the image sensor S2 sense electric potential on the photoconductor after exposure and toner density on the photoconductor after development, respectively, and send those sensed data to the controller (not shown) for setting and controlling image forming conditions appropriately.

The recording medium P whereon the full color toner image on the primary intermediate transfer belt 21 has been transferred is transported towards the fixing apparatus 60 by the feed belt 51 of the recording medium transport device 50. The surface of the feed belt 51 is charged by the recording medium suction charger 58 beforehand to ensure that the recording medium P can be reliably fed on the feed belt 51. The destaticizer and separation charger 57 then operates to ensure that the recording medium P is separated from the feed belt 51 and fed reliably to the fixing apparatus 60.

The full color toner image on the recording medium P is fixed by the heat of the fixing apparatus 60 and melted, and colors mixed, to form a complete full color image. Since toner is present only on one face (the top surface) of the recording medium, the heat energy required for fixing is low compared to that for double-faced recording with toner images on both surfaces. The control device (not shown) controls the electric power used by the fixing apparatus to the optimum in response to the image.

Until the fixed toner becomes fully hardened on the recording medium, toner images may be rubbed by the feed path guide members and the like, and image drop-out and disturbance may occur. To prevent this problem, a pair of cooling rollers 70 being a cooling device operates to cool the toner and recording medium.

The recording medium is ejected by the ejecting rollers 71 with the toner image on the upper side. The order of pages to be formed is controlled so that a smaller-numbered page is stacked on a larger-numbered page. As the recording medium stack tray 75 moves downward as the number of the stacked recording media increases, the recording media are stacked in order. Instead of stacked in the recording medium stack tray 75, recording media may be transferred to the recording medium processing apparatus for punching, cutting, folding, binding, etc.

Another method whereby the image is carried by the second intermediate transfer belt 21 and transferred to the recording medium will be executed basically the same way, except the second image formation units 81Y through 81K form toner images instead of the first image formation units 80Y through 80K, and the smaller-numbered pages are formed earlier than the larger-numbered pages so as to control the order of the pages appropriately.

Operation during double-faced recording wherein an image is formed on both faces of the recording medium P will be described below.

When the start signal is input to the image formation apparatus, an image in each color is formed in sequence on the first image formation units 80Y, 80C, 80M, and 80K, and primary-transferred in sequence to the primary intermediate transfer belt 21. Almost in parallel with the process of carrying this image as the first image, a process is conducted whereby the images of each color formed in sequence on the second image formation units 81Y, 81C, 81M, and 81K are primary-transferred in sequence to the second intermediate transfer belt 31 and carried as second images. Furthermore, since the recording medium is halted and fed again by the pair of registration rollers 45, the recording medium is supplied in consideration of this time period, and aligned with the horizontal registration compensation mechanism 44. The pair of registration rollers 45 feed the recording medium to the first transfer position comprising the first secondary transfer roller 46 and the first intermediate transfer belt 21 with the appropriate timing. A positive transfer current flows in the first secondary transfer roller 46, and the image is transferred from the first intermediate transfer belt to upper face of the recording medium P.

The recording medium P having an image on one face in this manner is then fed to the second secondary transfer roller 47 at the second transfer position. By applying a positive transfer current to the second secondary transfer roller 47, the full color second image already carried on the second intermediate transfer belt 31 is transferred to the lower face of the recording medium P in one action.

The recording medium P whereon full color toner images have been transferred to both faces in this manner is fed to the fixing apparatus 60 by the feed belt 51. The surface of the feed belt 51 is charged with a negative charge (same polarity as the toner) by the suction charger 57. Care is taken to ensure that toner on the lower face of the recording medium which is not yet fixed is not transferred to the belt. An alternating current is applied to the destaticizer and separation charger 58, and the recording medium is separated from the belt 51 and transported to the fixing apparatus 60. The toner images on both faces of the recording medium are fixed by the heat of the fixing apparatus 60 and melted so that colors mix. The recording medium is then passed through the pair of cooling rollers and ejected by the ejecting rollers 71 to the recording medium stack tray 75.

When double-faced recording is executed on plural number of recording media, the control device controls recording so that smaller-numbered pages are formed on the lower face of the recording medium. With that control, when printed documents are taken out of the recording medium stack tray 75 and turned upside down, those documents are arranged in order so that a first page is on upper face of a first recording medium, a second page is on lower face of the first recording medium, a third page is on upper face of a second recording medium, a forth page is on lower face of the second recording medium and so on.

Although the motions of the image forming apparatus forming full color images have been shown in this embodiment, monochrome images can be also formed.

Figure 15:
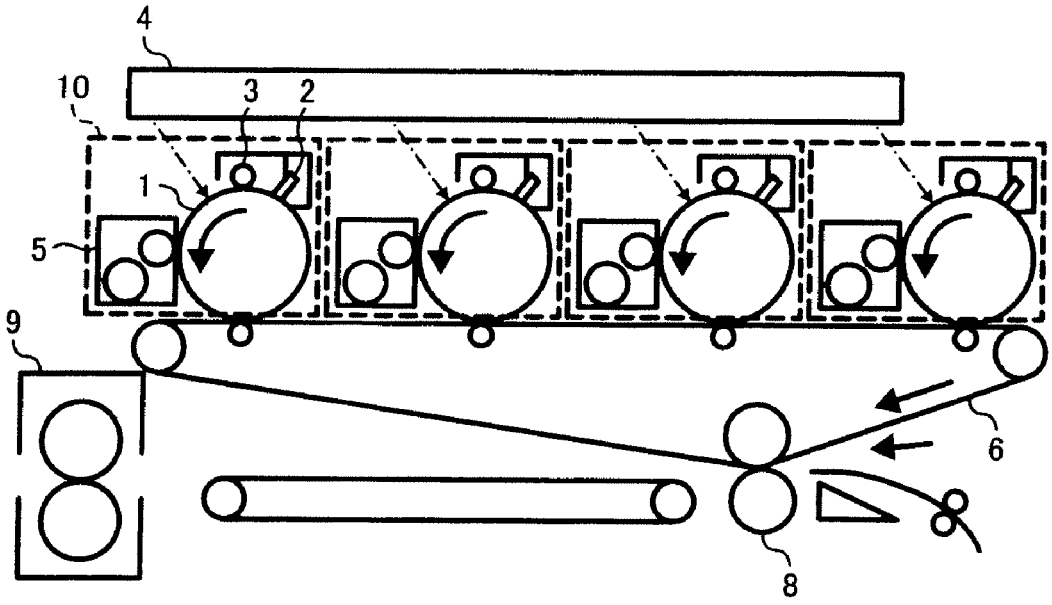
FIG. 15 shows an image forming apparatus to which the present invention can be applied.

Another image forming apparatus to which the present invention can be applied will be illustrated in FIG. 15. This image forming apparatus is so called tandem type and forms a toner image only on one side of recording medium at a time.

In FIG. 15, process cartridges are arranged in a row. The process cartridge is defined here as a detachable cartridge including a latent image carrier and a developing device. The process cartridge is detachable from an image forming apparatus such as a copying machine, printer or the like. In FIG. 15, each process cartridge 10 forms toner images with each color. Each process cartridge 10 includes a photoconductor 1, a charging device 3, a developing device 5 and a cleaning device 2. Also, there are other elements in the image forming apparatus such as an optical writing device 4, an intermediate transfer device 6, a transfer device 8, a fixing device 9, recording medium feeding member and so on.

The function of each element is the same as explained in FIG. 13 except the second image formation part 30 is missing. The photoconductor 1, the charging device 3, the developing device 5 and the cleaning device 2 have the same function as elements with same index number in FIGS. 13 and 14. The intermediate transfer device 6 has the same function as intermediate transfer belt 21 in FIG. 13 and the fixing device 9 has the same function as the fixing apparatus 60 in FIG. 13.

Next, preferable carrier particles for present invention will be discussed.

Preferably, a volume average diameter of the carrier particles is from 20 μm to 60 μm. By using carrier particles with the volume average diameter not greater than 60 μm, it is possible to reduce the amount of the developer on the developer bearing device 205 without damaging the ability of development. Reducing the amount of the developer in the developing device provides the following advantages.

(1) extending the lifetime of the carrier particles because of less stress to the carrier particles when the carrier particles pass through the regulating member which is configured to regulate the amount of the developer on the developer bearing member 205;

(2) reducing the inside volume of the developing device; and (3) achieving high quality image because the magnetic brush has a higher density in the development area.

If carrier particles with volume average diameter greater than 60 μm are used, overflow of the carrier particles may happen during circulation. On the other hand, if carrier particles with volume average diameter smaller than 20 μm are used, carrier adhesion to the photoconductor or scattering of the carrier particles from the developing device may happen.

With regard to measuring the average particle diameter of carrier particle, an SRA-type microtrack particle size analyzer (manufactured by Nikkiso Co., Ltd.) is used with a range of from 0.7 to 125 μm.

It is preferable to use toner particles with an volume average diameter (D4) of 3 μm to 8 μm. The toner particles with a small diameter and a sharp particle size distribution make the distance between the toner particles small and lead to the following effects.

(1) the required amount of toner particles can be reduced without damaging the reproduction of color. Thus, the fluctuation in density can be reduced.

(2) small dots in images with the resolution higher than 600 dpi can be formed more stably. Thus, stable images can be formed for longer time.

On the other hand, if toner particles with an volume average diameter (D4) smaller than 3 μm are used, it tends to be difficult to transfer the toner particles efficiently or to clean the toner particles with a cleaning blade. If toner particles with a volume average diameter (D4) larger than 8 μm are used, the height of toner images tends to be large and it tends to be difficult to suppress the scattering of the toner particles when a character image or line image is formed.

Further, it is preferable to use toner particles with a ratio of D4/D1 from 1.00 to 1.30, where D1 represents the number average diameter of the toner particles. The closer to 1.00 D4/D1 becomes, the sharper the particle size distribution of the toner particles becomes. The toner particles with a smaller diameter and a sharp distribution like this are preferable to achieve the sharper distribution of the charging quantity of the toner particles, and higher image quality with less toner adhesion to the photoconductor and higher efficiency in transferring the toner particles electrically.

Specific examples of devices measuring particle size distribution of toner particles using the Coulter method include Coulter Counter TA-II and Coulter Multisizer II (both are manufactured by Beckman Coulter Inc.). The measuring method is described below.

(1) Add 0.1 to 5 ml of a surface active agent (preferably a salt of an alkyl benzene sulfide) as a dispersant to 100 to 150 ml of an electrolytic aqueous solution. The electrolytic aqueous solution is an about 1% NaCl aqueous solution prepared by using primary NaCl (e.g., ISOTON-II, manufactured by Beckman Coulter Inc.).

(2) Add 2 to 20 mg of a measuring sample to the electrolytic aqueous solution.

(3) Subject the electrolytic aqueous solution in which the measuring sample is suspended to a dispersion treatment for 1 to 3 minutes with a supersonic disperser.

(4) Measure the number distribution for each particle diameter channel described below while the aperture is set to 100 μm for the measuring device mentioned above.

(5) Calculate the weight average particle diameter (D4) and the number average particle diameter (D1) of the toner from the obtained distribution. The whole range is a particle diameter of from 2.00 to not greater than 40.30 μm and the number of the channels is 13. Each channel is: from 2.00 to not greater than 2.52 μm; from 2.52 to not greater than 3.17 μm; from 3.17 to not greater than 4.00 μm; from 4.00 to not greater than 5.04 μm; from 5.04 to not greater than 6.35 μm; from 6.35 to not greater than 8.00 μm; from 8.00 to not greater than 10.08 μm; from 10.08 to not greater than 12.70 μm; from 12.70 to not greater than 16.00 μm, from 16.00 to not greater than 20.20 μm; from 20.20 to not greater than 25.40 μm; from 25.40 to not greater than 32.00 μm; and from 32.00 to not greater than 40.30 μm.

Figure 16:
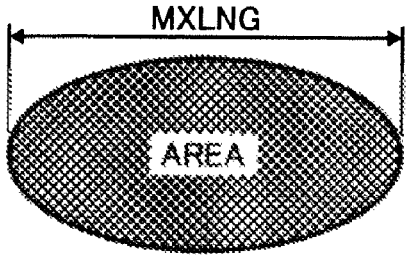
FIG. 16 shows a schematic diagram for explaining the form factor SF-1.
Figure 17:
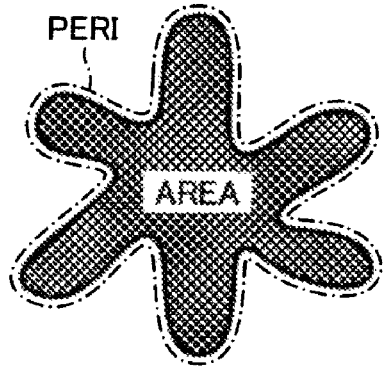
FIG. 17 shows a schematic diagram for explaining the form factor SF-2.

In addition, the toner of the present invention preferably has a form factor SF-1 of from 100 to 180 and a form factor of SF-2 of from 100 to 180. FIGS. 16 and 17 are schematic diagrams for explaining the form factors SF-1 and SF-2.

The form factor SF-1 represents the degree of roundness of a toner particle and is defined by the following relationship (1):

$$SF\text{-}1=\{(MXLNG)^2/(\mathrm{AREA})\}\times(100\pi/4) \quad (1)$$

wherein, MXLNG represents a diameter of the circle circumscribing the image of a toner particle obtained, for example, by observing the toner particle with a microscope, and AREA represents the area of the image.

When a toner has a form factor SF-1 close to 100, the toner has a form close to a true sphere. When the form factor SF-1 is too high, the form is irregular.

The form factor SF-2 represents the degree of concavity and convexity of a toner particle and is defined by the following relationship (2):

$$SF\text{-}2=\{(PERI)^2/(\text{AREA})\}\times(100/4\pi) \quad (2)$$

wherein, PERI represents the peripheral length, or perimeter, of the image of a toner particle observed, for example, by a microscope; and AREA represents the area of the image. When the form factor SF-2 gets close to 100, the toner has a surface with less concavity and convexity. When the form factor SF-2 is too large, the roughness of the surface is significant.

The form factors SF-2 are determined by the following method. Photographs of the toner particles are taken using a scanning electron microscope (S-800, manufactured by Hitachi Ltd.). The photographs are analyzed using an image analyzer (LUSEX 3 manufactured by Nireco Corp.) to calculate the form factors.

When a toner has a form factor SF-1 close to 100, that is, the toner has a form close to a true sphere, the contact between the toner particles becomes a point to point contact. Thereby the adhesion force between the toner particles weakens and therefore, the toner has a good fluidity. Good fluidity of toner particles leads less stress and it becomes easier to stabilize the flow of the developer for a longer time. Also, if the toner has a form close to a true sphere, the contact between toner particles and the photoconductor becomes a point to point contact. Thereby the adhesion force between the toner particles and the photoconductor weakens and therefore, the efficiency in transferring the toner particles is improved and higher image quality is achieved.

On the other hand, if either of SF-1 or SF-2 becomes greater than 180, the fluidity of the developer becomes bad and it becomes difficult to flow the developer smoothly. Also, the efficiency in transferring the toner particles tends to decline.

In this embodiment, external additive agents having primary particle diameters from 50 nm to 500 nm and a bulk density greater than 0.3 mg/cm$^3$ are adhered to the toner particles.

Silica agents are often used as the external additive agents to increase the fluidity of the developer, but usually, its primary particle diameter is from 10 nm to 30 nm and its bulk density is from 0.1 mg/cm$^3$ to 0.2 mg/cm$^3$.

In the present invention, external additive agents having an appropriate characteristic preferably exist on the surface of the toner particles to form a gap between the toner particles and objects such as photoconductors. As the external additive agents are uniformly contacted with the toner particles, the photoconductor and the charging member have a small contact area. Thus, the adherence of the toner to the photoconductor and charging member can be decreased, and the developing efficiency and the transfer efficiency of the toner can also be improved. Also, external additive agents increase the fluidity of the developer and therefore decrease stress on the developer. Accordingly, the developer can be used for a longer period of time.

In addition, the external additive agents plays a role as a roller bearing, so that the photoconductor is not abraded and damaged. Moreover, the external additive particle is hardly embedded into the toner particles even when a high stress is applied to the photoconductor by the cleaning blade. Even if the external additive agents are slightly embedded to the toner particles, the external additive agents can leave from the toner particles and the developer can recover. Therefore, a stable cleanability can be imparted to the toner particles for a long period. Furthermore, the external additive agents moderately leaves from the surface of the toner particles and are adhered to the edge of the cleaning blade, resulting in function of a dam. The dam has an effect on avoiding the phenomenon in that the toner passes through the cleaning blade.

The external additive agents mentioned above decrease the shear applied to the toner, and thereby formation of a film of the toner on the photoconductor, etc., which is caused by the low-rheological components included in the toner, in a high-speed fixation (low-energy fixation) is reduced. In addition, external additive agents having an average primary particle diameter of from 50 to 500 nm improve the cleaning property of the resultant toner without decreasing the fluidity of the resultant toner. The reason is not certain, but is considered as follows. When a surface-treated external additive agents are added to the toner particles, the deterioration level of the developer is low even if the external additive agents contaminate the carrier particles. Therefore, the deterioration of the fluidity and charging quantity is sufficiently suppressed for a longer period, the flow of the developer is stabilized and image quality is stabilized.

The external additive agents preferably have an average primary particle diameter of from 50 to 500 nm, and preferably from 100 to 400 nm. When the average primary particle diameter is less than 50 nm, the external additive agents tend to be buried in the concavity of the toner surface and deteriorate the role of the roller bearing. In contrast, when the average primary particle diameter is larger than 500 nm, the defective cleaning problem in that the toner passes through the blade occurs. This is because the external additive agents have a particle diameter on the order of that of the toner, and the toner particles passes through the gap formed between the cleaning blade and the photoconductor by the external additive agents.

The bulk density of the external additive agents is preferably not less than 0.3 mg/cm$^3$. When the bulk density is too small, the fluidity of the toner improves, but the resultant toner and the external additive agents are easily scattered and the adherence thereof to the photoconductor, etc. is increased. Therefore, the dam effect deteriorates, resulting in occurrence of defective cleaning.

Specific examples of inorganic particles for use as the external additive agents include $SiO_2$, $TiO_2$, $Al_2O_3$, MgO, CuO, ZnO, $SnO_2$, $CeO_2$, $Fe_2O_3$, BaO, CaO, $K_2O$, $Na_2O$, $ZrO_2$, $CaO.SiO_2$, $K_2O(TiO_2)n$, $Al_2O_3.2SiO_2$, $CaCO_3$, $MgCO_3$, $BaSO_4$, $MgSO_4$, $SrTiO_3$, etc. Among these, $SiO_2$, $TiO_2$ and $Al_2O_3$ are preferably used. These inorganic compounds may be treated by a surface treatment agent such as coupling agents, hexamethyldisilazane, dimethyldichlorosilane, and octyltrimethoxysilane.

Specific examples of organic particles for use as the external additive agents include thermoplastic resins and thermosetting resins, such as vinyl resins, polyurethane resins, epoxy resins, polyester resins, polyamide resins, polyimide resins, silicone resins, phenol resins, melamine resins, urea resins, aniline resins, ionomer resins, polycarbonate resins, etc. These resins may be used in combination. In order to easily make a water dispersion of fine resin particles, vinyl resins, polyurethane resins, epoxy resins, polyester resins and these combinations are preferably used.

Specific examples of the vinyl resins for use as the external additive agents include polymers formed from a polymerization reaction or a copolymerization reaction of vinyl monomer such as styrene-methacrylate copolymers, styrene-butadiene copolymers, methacrylic acid-methacrylate copolymers, styrene-acrylonitrile copolymers, styrene-maleic anhydride copolymers, styrene-methacrylic acid copolymer, etc.

The bulk density of the external additive agents is measured as follows:

Putting the external additive agents gradually into a measuring cylinder with 100 mL volume without vibration till the amount of external additive agents becomes 100 mL. Then the weight of external additive agents (Wa) is obtained by subtracting the weight of the measuring cylinder without the external additive agents from the weight of the measuring cylinder with 100 mL of the external additive agents.

The bulk density of the external additive agents (Be) is obtained by following calculation.

$$Be(\mathrm{g/cm^3})=Wa(\mathrm{g/100\ mL})/100$$

In the present invention, the external additive agents are typically added to the toner by a method including; mechanically mixing mother toner particles and an external additive by a known mixing device; or a method including dispersing the mother toner particles and the external additive in a liquid using a surfactant to adhere to, and drying.

Next, developer replenishing devices applicable to the present invention will be discussed.

The developing device of this embodiment has an opening as a toner introduction part through which new toner particles and carrier particles are sent to the developing device. Also, the developing device of this embodiment has an opening as a toner discharge part which discharges the developer from the developing device.

Figure 18A:
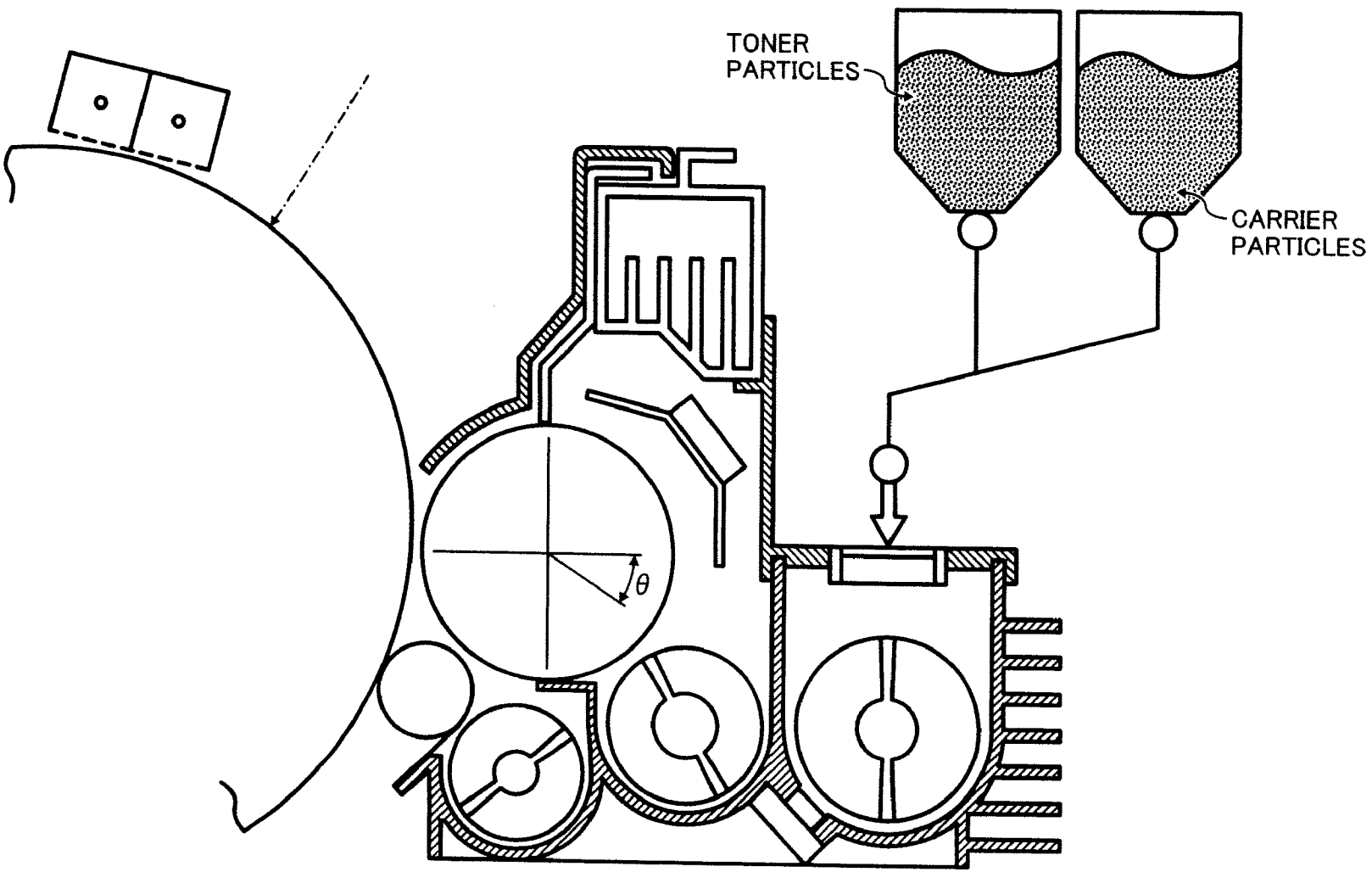
FIG. 18A shows the toner particles replenishing device and the carrier particles replenishing device.

The first example of the developer replenishing device is shown in FIG. 18A. The developer replenishing device comprises a toner replenishing device which includes a toner container for containing toner particles, a carrier replenishing device which includes a carrier container for containing carrier particles, a toner replenishing controller for controlling the replenishment of the toner particles, a carrier replenishing controller for controlling the replenishment of the carrier particles and a developer conveyance path. The toner container joins with the carrier container at a point in the developer conveyance path, and the toner particles and the carrier particles are conveyed together to the opening in the developing device as the toner introduction part.

The amount of replenished toner particles is controlled by the toner replenishing controller and the amount of replenished carrier particles is controlled by the carrier replenishing controller. The toner replenishing controller and the carrier replenishing controller can control the amount of the replenished powder independently to each other.

The toner replenishing device and the carrier replenishing device essentially have the same structure. Either of those replenishing devices can rotate and has an opening with a shutter so that the shutter is opened or closed in accordance with the rotating motion of those replenishing devices and the amount of the replenished toner particles or replenished carrier particles is controlled according to the quantity of rotations, θ.

A sensor for sensing the toner density is disposed at the downstream of the developer agitating conveyer and the amount of replenished toner particles is controlled by the toner replenishing controller in response to the output of this sensor. The amount of replenished carrier particles is controlled by the carrier replenishing controller according to the deterioration of the carrier which can be estimated according to the driving time of the developing device or the like.

The positional restriction to dispose the toner container is relatively little when this type of the developer replenishing device is adapted. It increases freedom to allocate the space inside the image forming apparatus because the toner container and the carrier container are separate from the developing device. And since the toner particles are replenished from the toner container, it is not necessary for the developing device to have large space for containing the toner particles to be replenished. So the developing device can be downsized.

Figure 18B:
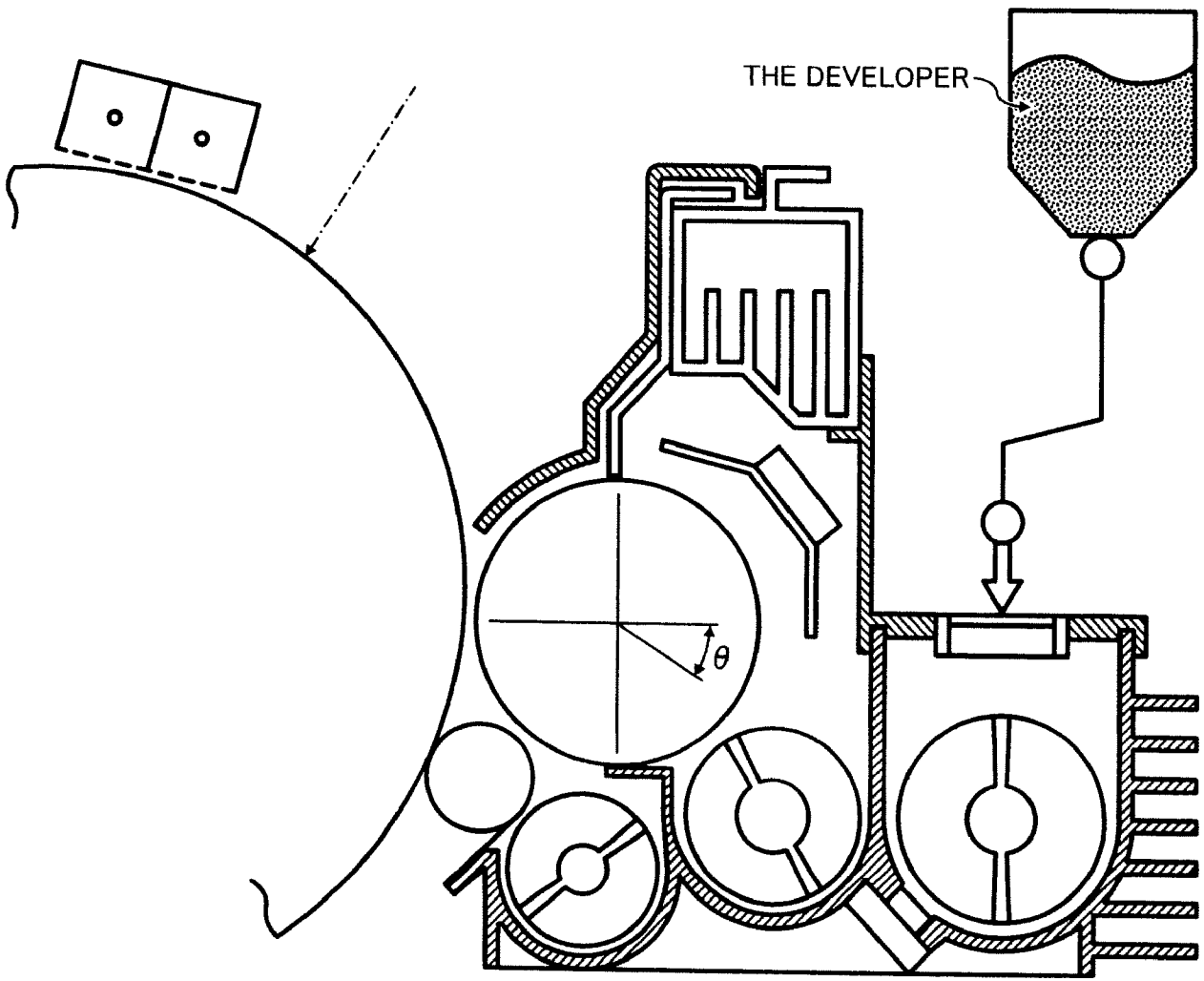
FIG. 18B shows the developer replenishing device.

The second example of the developer replenishing device is shown in FIG. 18B. The developer replenishing device includes a developer container for containing new toner particles and new carrier particles together, a developer replenishing controller for controlling the replenishment of the developer and a developer conveyance path along which the developer is conveys to the opening of the developing device. The weight percent of the toner particles in the new developer is approximately 15% by weight. The weight percent of the toner particles is not restricted to 15%. It is decided according to the developing device, the capacity of the developer container, the lifetime of the developer or the like. The developer can be conveyed by a screw pump which is shown in U.S. Pat. No. 6,785,496.

A toner density sensor is placed below the developer agitating conveyer and the developer is replenished according to output signals from this sensor.

The positional restriction to dispose the toner container is relatively little when this type of the developer replenishing device is adapted. It increases freedom to allocate the space inside the image forming apparatus because the developer container is separate from the developing device. And since the toner particles are replenished from the toner container, it is not necessary for the developing device to have large space for containing the toner particles to be replenished. So the developing device can be downsized.

Although the developer replenishing devices shown in FIGS. 18A and 18B replenish the carrier particles as well as toner particles, a developer replenishing device which replenishes toner particles only is also applicable to the present invention.

What is claimed as new and desired to be secured by Letters Patent of the United States is:

1. A developing device comprising:

a developer bearing member configured to carry a developer to a development area so that the developer on the developer bearing member faces a latent image carrier for development process;

a developer supplying conveyer configured to supply the developer to the developer bearing member while conveying the developer in a widthwise direction;

a developer receiving conveyer configured to receive the developer from the developer bearing member after development while conveying the developer in the widthwise direction;

a developer agitating conveyer configured to receive the developer from the developer receiving conveyer and the developer supplying conveyer and configured to supply the developer to the developer supplying conveyer while agitating and conveying the developer in the widthwise direction, wherein the developer supplying conveyer or the developer receiving conveyer has at least one dividing position, the dividing position is a position at which the conveying direction of the developer reverses, and a position which is arranged so that if the dividing position is projected to the developer bearing member along a plane which is perpendicular to the widthwise direction of the developer bearing member, the projected position on the developer bearing member is within an area in which the developer is borne on the developer bearing member.

2. The developing device according to claim 1, wherein at least one dividing position exists on each of the developer supplying conveyer and the developer receiving conveyer.

3. The developing device according to claim 1, wherein the number of the dividing position on the developer supplying conveyer is the same as the number of the dividing position on the developer receiving conveyer.

4. The developing device according to claim 3, wherein each projected position of the dividing position on the developer supplying conveyer is the same position as each projected position of the dividing position on the developer receiving conveyer, the projected position is a projected position to the developer bearing member along the plane which is perpendicular to the widthwise direction of the developer bearing member.

5. The developing device according to claim 1, wherein the conveying direction of the developer on the developer receiving conveyer is the same as the conveying direction of the developer on the developer supplying conveyer.

6. The developing device according to claim 1, wherein the projected position of the dividing position divides the widthwise length of an area in which the development process is executed equally, the projected position is a projected position to the developer bearing member along the plane which is perpendicular to the widthwise direction of the developer bearing member.

7. The developing device according to claim 1, wherein toner particles are replenished to each of sub-area, a sub-area is a divided area by a imaginary plane or imaginary planes, each of which includes one dividing position and is perpendicular to the widthwise direction of the developer bearing member in a manner that n planes divide an area into n+1 sub-areas, and wherein n is a whole number index.

8. The developing device according to claim 7, wherein each two positions to which toner particles are replenished are disposed symmetrically with respect to an imaginary plane which is disposed between two replenishing position, includes one dividing position and is perpendicular to the widthwise direction of the developer bearing member.

9. The developing device according to claim 7, wherein a replenishing period of toner particles in a first sub-area is different from a replenishing period of toner particles in a second sub-area next to the first sub-area.

10. The developing device according to claim 9, wherein a difference of time between the replenishing period in the first sub-area and the replenishing period in the second sub-area next to the first sub-area is arranged so that toner particles are replenished alternatively to one of two replenishing positions at a time.

11. The developing device according to claim 1, wherein the developer supplying conveyer and the developer receiving conveyer each has only one dividing position, the developer is conveyed from a center to ends on the developer supplying conveyer and the developer receiving conveyer and an opening is disposed at the center in the width wise direction of a partitioning member which partitions the developer supplying conveyer from the developer agitating conveyer.

12. The developing device according to claim 1, wherein the developer supplying conveyer and the developer receiving conveyer each has only one dividing position, the developer is conveyed from ends to a center on the developer supplying conveyer and the developer receiving conveyer and an opening is disposed at the center in the width wise direction of a partitioning member which partitions the developer supplying conveyer from the developer agitating conveyer.

13. The developing device according to claim 1, wherein a partitioning member is disposed at least at one dividing position, the partitioning member is configured to physically prevent the developer from passing through the dividing position.

14. The developing device according to claim 1, wherein at least one of the developer supplying conveyer and the developer receiving conveyer have a screw form, and the winding pitch of the screw becomes gradually longer at a closer position to the dividing position than the winding pitch of the screw at a further position from the dividing position.

15. The developing device according to claim 1, wherein at least one of the developer supplying conveyer and the developer receiving conveyer is arranged so that the conveying speed of the developer at a closer position to the dividing position is slower than the conveying speed of the developer at a further position from the dividing position.

16. The developing device according to claim 1, wherein the developer receiving conveyer, the developer supplying conveyer and the developer agitating conveyer are arranged so that the three conveyers lines extend approximately horizontally.

17. The developing device according to claim 1, wherein the developing device has a developer introduction part through which the developer is sent to the developing device and a developer discharge part which discharges the developer from the developing device.

18. The developing device according to claim 1, wherein the developer includes toner particles and carrier particles, wherein the developing device has a developer introduction part through which toner particles coming from a toner particles container and carrier particles coming from a carrier particles container are sent to the developing device in the manner that the amount of the replenished toner particles and the amount of the replenished carrier particles are controlled independently to each other.

19. The developing device according to claim 1, wherein the developer includes toner particles and carrier particles and carrier particles used in an image forming apparatus have an volume average particle diameter from 20 μm to 60 μm.

20. The developing device according to claim 1, wherein toner particles used in the developing device have a volume average diameter (D4) from 3 μm to 8 μm and a ratio of D4/D1 is from 1.00 to 1.30, wherein D1 represents an number average diameter of toner particles.

21. The developing device according to claim 1, wherein toner particles used in the developing device have a factor SF-1 from 100 to 180 and SF-2 from 100 to 180, SF-1 is defined by the following relationship (1), SF-2 is defined by the following relationship (2)

$$SF\text{-}1=\{(MXLNG)^2/(\mathrm{AREA})\}\times(100\pi/4) \quad (1)$$

$$SF\text{-}2=\{(PERI)^2/(\mathrm{AREA})\}\times(100/4\pi) \quad (2)$$

wherein MXLNG is a diameter of a circle circumscribing an image of a toner particle obtained, AREA is an area of the image, PERI is a peripheral length of the image of a toner particle observed.

22. The developing device according to claim 1, wherein toner particles used in the developing device have external additive agents having a primary particle diameter from 50 nm to 500 nm and a bulk density greater than 0.3 mg/cm$^3$.

23. An process cartridge configured to be detachable from an image forming apparatus, comprising:

a latent image carrier;

the developing device according to claim 1 configured to develop latent images on the latent image carrier to toner images.

24. An image forming apparatus comprising:

a latent image carrier;

the developing device according to claim 1 configured to develop latent images on the latent image carrier to toner images;

a transfer device configured to transfer the toner images on the latent image carrier to recording media;

a fixing device configured to fix the toner images to the recording media.

25. The image forming apparatus according to claim 24, wherein the image forming apparatus forms color toner images by superimposing plural types of toner particles and has plural developing devices each of which is configured to develop latent images to toner images with each color of toner particles.

26. The image forming apparatus according to claim 24, further comprising:

a first image forming part configured to form toner images on a first face of a recording medium, the first image forming part includes a first intermediate transfer belt and plural first image formation units, each of which is configured to develop toner images of each color, each of the first image formation units has at least a photoconductor and the developing device, each of the first image formation units includes at least the one latent image carrier and the one developing device, a second image forming part configured to form toner images on a second face of the recording medium, the second image forming part includes a second intermediate transfer belt and plural second image formation units each of which is configured to develop toner images of each color, each of the second image formation units has at least the photoconductor and the developing device, each of the second image formation units includes at least the latent image carrier and the developing device.

27. A method of developing latent images to toner images using the developing device according to claim 1, comprising:

a step of forming latent images on the latent image carrier; and a step of developing the latent images on the latent image carrier to toner images.

28. A developing device comprising:

a developer bearing member configured to bear and carry a developer to an development area so that the developer on the developer bearing member faces to a latent image carrier for development process, a developer supplying conveyer configured to supply the developer to the developer bearing member while conveying the developer in a widthwise direction, a developer receiving conveyer configured to receive the developer from the developer bearing member after development while conveying the developer in the widthwise direction, a developer agitating conveyer configured to receive the developer from the developer receiving conveyer and the developer supplying conveyer and configured to supply the developer to the developer supplying conveyer while agitating and conveying the developer in the widthwise direction, means for reversing a conveying direction of the developer disposed at a dividing position on the developer supplying conveyer or the developer receiving conveyer, wherein the dividing position is arranged so that if the dividing position is projected to the developer bearing member along a plane which is perpendicular to the widthwise direction of the developer bearing member, the projected position on the developer bearing member is within an area in which the developer is borne on the developer bearing member.

29. A developing device comprising:

a developer bearing member configured to carry a developer to a development area so that the developer on the developer bearing member faces a latent image carrier for development process;

a developer supplying screw configured to supply the developer to the developer bearing member while conveying the developer in a widthwise direction;

a developer receiving screw configured to receive the developer from the developer bearing member after development while conveying the developer in the widthwise direction;

a developer agitating conveyer configured to receive the developer from the developer receiving screw and the developer supplying screw and configured to supply the developer to the developer supplying screw while agitating and conveying the developer in the widthwise direction, wherein the developer supplying screw or the developer receiving screw has at least one dividing position, the dividing position at which a winding direction of the developer supplying screw or the developer receiving screw is reversed, and a position which is arranged so that if the dividing position is projected to the developer bearing member along a plane which is perpendicular to the widthwise direction of the developer bearing member, the projected position on the developer bearing member is within an area in which the developer is borne on the developer bearing member.

30. The developing device according to claim 29, wherein at least one dividing position exists on each of the developer supplying screw and the developer receiving screw.

31. The developing device according to claim 29, wherein a number of the dividing position on the developer supplying screw is the same as a number of the dividing position on the developer receiving screw.

32. The developing device according to claim 31, wherein each projected position of the dividing position on the developer supplying screw is the same position as each projected position of the dividing position on the developer receiving screw, the projected position is a projected position to the developer bearing member along the plane which is perpendicular to the widthwise direction of the developer bearing member.

33. The developing device according to claim 29, wherein the conveying direction of the developer on the developer receiving screw is the same as the conveying direction of the developer on the developer supplying screw.

34. The developing device according to claim 29, wherein the projected position of the dividing position divides the widthwise length of an area in which the development process is executed equally, the projected position is a projected position to the developer bearing member along the plane which is perpendicular to the widthwise direction of the developer bearing member.

35. A developing device comprising:

a developer bearing member configured to carry a developer to a development area so that the developer on the developer bearing member faces a latent image carrier for development process, a developer supplying screw configured to supply the developer to the developer bearing member while conveying the developer in a widthwise direction, a developer receiving screw configured to receive the developer from the developer bearing member after development while conveying the developer in the widthwise direction, wherein the developer supplying screw or the developer receiving screw has at least one dividing position, the dividing position at which the winding direction of the screw is reversed, and the position is arranged so that, if the dividing position is projected to the developer bearing member along a plane which is perpendicular to the widthwise direction of the developer bearing member, the projected position on the developer bearing member is within an area in which the developer is borne on the developer bearing member.

36. An image forming apparatus comprising:

a developing device according to claim 35, a developer agitating conveyer configured to receive the developer from the developer receiving screw and configured to supply the developer to the developer supplying screw.

37. An image forming apparatus according to claim 36 comprising:

a toner container storing toner, wherein the toner is supplied from the toner container to the developer agitating conveyer.

* * * * *